US008146606B2

(12) United States Patent
Schatteman et al.

(10) Patent No.: US 8,146,606 B2
(45) Date of Patent: Apr. 3, 2012

(54) DEVICE AND METHOD FOR MIXING HAIR COLORING CHEMICALS

(75) Inventors: Cristophe Schatteman, Beverly Hills, CA (US); Joshua B. Sybrowsky, Lincoln, CA (US)

(73) Assignee: Cristophe Schatteman, Beverly Hills, CA (US)

( * ) Notice: Subject to any disclaimer, the term of this patent is extended or adjusted under 35 U.S.C. 154(b) by 222 days.

(21) Appl. No.: 12/688,725

(22) Filed: Jan. 15, 2010

(65) Prior Publication Data

US 2011/0174330 A1 Jul. 21, 2011

(51) Int. Cl.
*A61Q 5/08* (2006.01)
*A45D 40/26* (2006.01)

(52) U.S. Cl. ..... 132/208; 132/320; 401/44

(58) Field of Classification Search ..... 132/218, 132/320, 208, 108–117; 401/44, 47, 132–134; 206/581, 823
See application file for complete search history.

(56) References Cited

U.S. PATENT DOCUMENTS

| | | | | |
|---|---|---|---|---|
| 5,337,764 | A | 8/1994 | McKay | |
| 5,778,902 | A | 7/1998 | Nagy | |
| 6,387,074 | B1 | 5/2002 | Horppu et al. | |
| 6,655,388 | B2 * | 12/2003 | Stevenson | 132/208 |
| 6,660,047 | B1 | 12/2003 | Stanley, III | |
| 7,322,365 | B2 | 1/2008 | Kelloyan | |

* cited by examiner

*Primary Examiner* — Rachel Steitz
(74) *Attorney, Agent, or Firm* — Trojan Law Offices

(57) ABSTRACT

A device and method for mixing and applying hair coloring chemicals to a user's hair. The device comprises a brush applicator, a first compartment capable of holding the brush applicator in a locked position, a second compartment containing a first hair coloring chemical, a third compartment containing a second hair coloring chemical, and a membrane. The membrane is located between the second compartment and the third compartment such that the first hair coloring chemical is separated from the second hair coloring chemical by the membrane when the brush applicator is in the locked position. When the brush applicator is released from the locked position, the brush applicator is movable toward the membrane to puncture the membrane. Upon puncture, the membrane retracts to a peripheral edge of the membrane to cause the first hair coloring chemical and the second hair coloring chemical to be mixed together.

46 Claims, 22 Drawing Sheets

DEVICE AND METHOD FOR MIXING HAIR COLORING CHEMICALS

BACKGROUND OF THE INVENTION

1. Field of the Invention

The invention herein relates to a device and method for mixing and applying hair coloring chemicals to a user's hair.

2. Background Information

Hair coloring is commonly used, which is considered to provide more fashionable or desirable looks. A number of different types of hair coloring are known, among which temporary hair color, semi-permanent hair color, demi-permanent hair color, and permanent hair color are the most common types. Temporary hair color can be obtained through rinses, shampoos, gels, sprays, and foams and lasts only from one shampoo to the next because color particles are deposited on the outside of the hair shaft. Semi-permanent hair color contains no or very low levels of developer, peroxide or ammonia, and the color usually lasts up to 4-5 shampoos because the pigment molecules can partially penetrate the hair shaft. Demi-permanent hair color contains a developer and an alkaline agent other than ammonia, and the color typically lasts up to 20-28 shampoos. Permanent hair color contains an alkalizing agent ammonia and a developer, the concentration of which is higher than the concentration of developer used in demi-permanent hair color. The permanent hair color will not wash out and is the only way to dye dark hair into a lighter shade.

A developer as used in demi-permanent hair color and permanent hair color is an oxidizing agent that opens the cuticle to allow the color to penetrate the cuticle layer. Typically, hydrogen peroxide is used as a developer.

SUMMARY OF THE INVENTION

A device for mixing and applying hair coloring chemicals to a user's hair of the present invention generally comprises a brush applicator, a first compartment capable of holding the brush applicator in a locked position, a second compartment containing a first hair coloring chemical, a third compartment containing a second hair coloring chemical, and a membrane. The first compartment is removably attachable to the second compartment, and the third compartment is capable of being connected to the second compartment. The membrane is located between the second compartment and the third compartment such that the first hair coloring chemical is separated from the second hair coloring chemical by the membrane when the brush applicator is in the locked position. When the brush applicator is released from the locked position, the brush applicator is movable toward the membrane to puncture the membrane. Upon puncture, the membrane retracts to a peripheral edge of the membrane to cause the first hair coloring chemical and the second hair coloring chemical to be mixed together.

A method of mixing and applying hair coloring chemicals to a user's hair of the present invention generally comprises: providing a device which comprises a first compartment holding a brush applicator in a locked position, a second compartment containing a first hair coloring chemical and being connected to the first compartment, a third compartment containing a second hair coloring chemical and being connected to the second compartment, a membrane located between the second compartment and the third compartment such that the first hair coloring chemical is separated from the second hair coloring chemical by the membrane, and a locking member preventing the brush applicator from contacting the membrane; rotating the first compartment relative to the second compartment to remove the locking member so as to release the brush applicator from the locked position; moving the brush applicator toward the membrane to puncture the membrane so that the membrane retracts to a peripheral edge of the membrane to cause the first hair coloring chemical and the second hair coloring chemical to be mixed together; scooping the mixed first hair coloring chemical and second hair coloring chemical out of the device using the brush applicator; and combing a user's hair by the brush applicator with the mixed first hair coloring chemical and second hair coloring chemical thereon, thereby applying the mixed first hair coloring chemical and second hair coloring chemical to the user's hair.

In another embodiment, a method of mixing and applying hair coloring chemicals to a user's hair of the present invention generally comprises: providing a device which comprises a first compartment holding a brush applicator in a locked position, a second compartment containing a developer or oxidizing agent and being connected to the first compartment, a membrane enclosing an end of the second compartment, and a locking member preventing the brush applicator from contacting the membrane; selecting a desired color to be applied to a user's hair; putting the color in a third compartment; attaching the third compartment containing the color to the device; rotating the first compartment relative to the second compartment to remove the locking member so as to release the brush applicator from the locked position; moving the brush applicator toward the membrane to puncture the membrane so that the membrane retracts to a peripheral edge of the membrane to cause the developer and the color to be mixed together; scooping the mixed developer and color out of the device using the brush applicator; and combing the user's hair by the brush applicator with the mixed developer and color thereon, thereby applying the mixed developer and color to the user's hair.

DETAILED DESCRIPTION OF THE INVENTION

Figure 1:
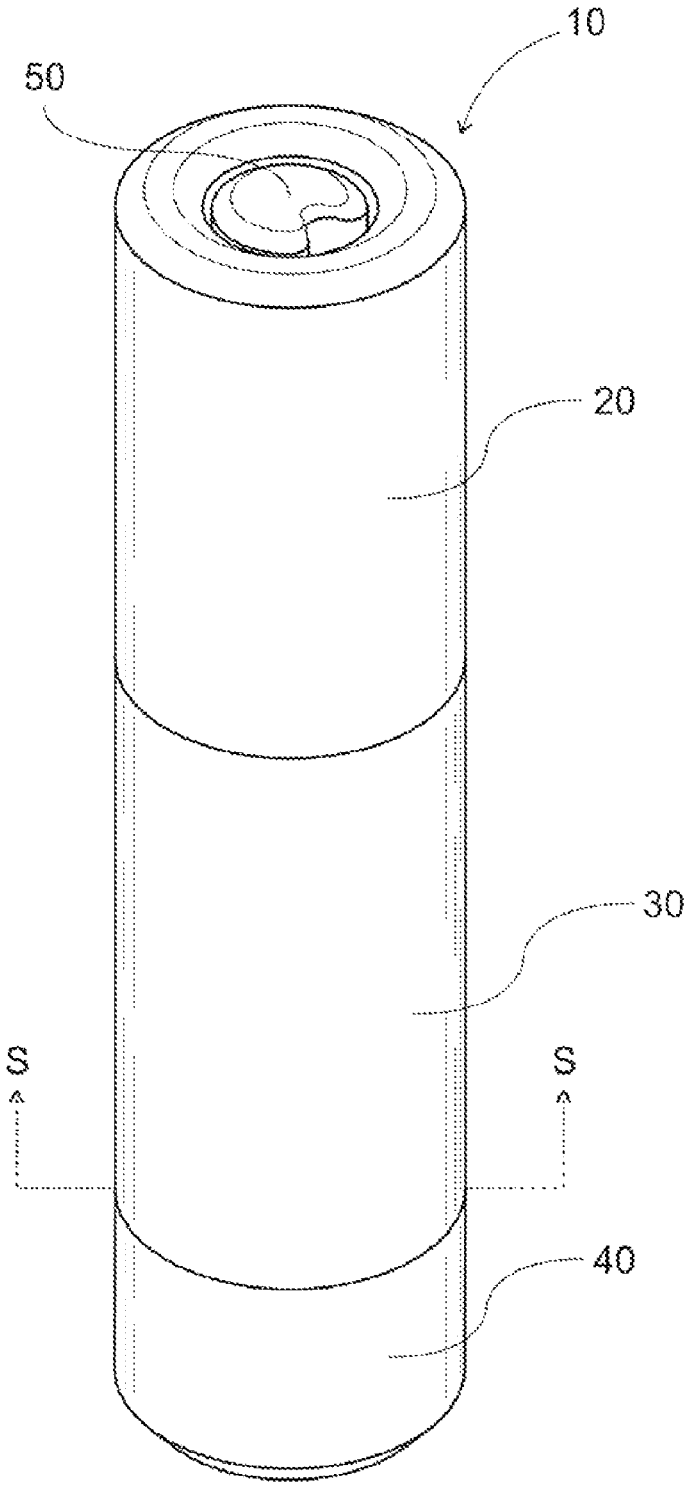
FIG. 1 is a perspective view of an embodiment of the present invention, showing that all structural elements thereof are assembled.
Figure 2:
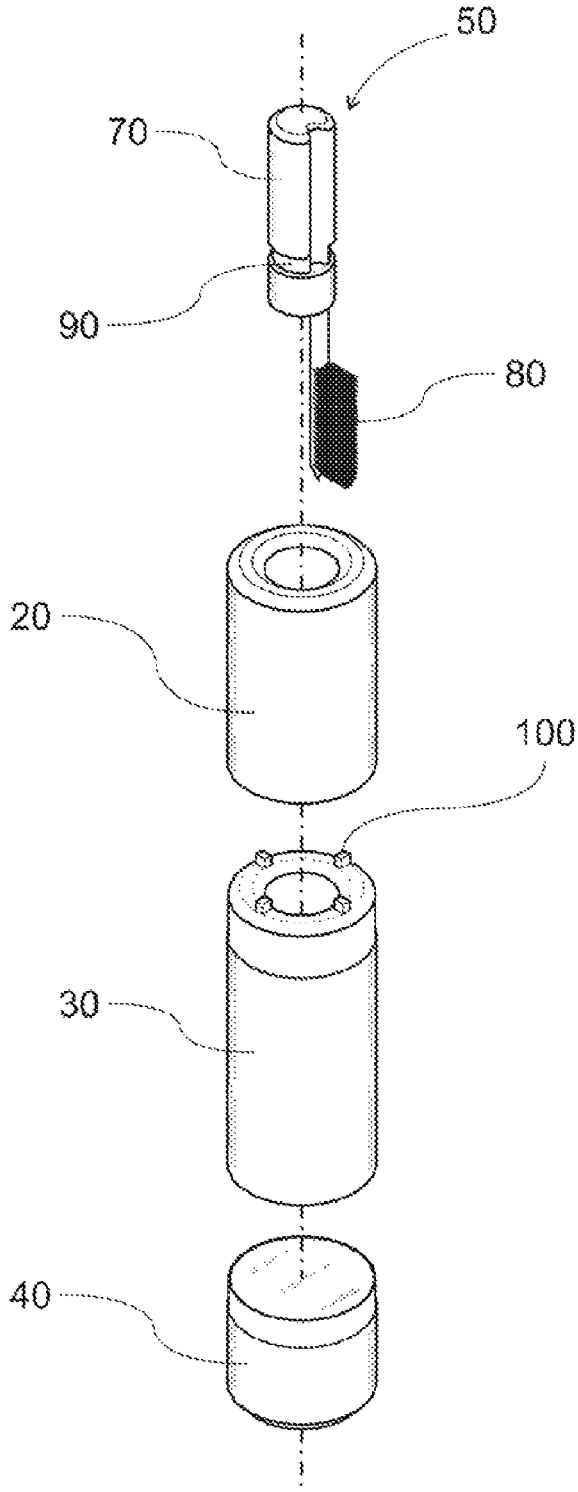
FIG. 2 is another perspective view of the embodiment of the present invention shown in FIG. 1, showing that structural elements thereof are dissembled.

FIGS. 1 through 7 illustrate an embodiment of a device and method for mixing and applying hair coloring chemicals to a user's hair of the present invention. A device 10 for mixing and applying hair coloring chemicals to a user's hair comprises a first compartment 20, a second compartment 30, a third compartment 40, a brush applicator 50, and a membrane 60. The first compartment 20 is removably attachable to one end of the second compartment 30, and the third compartment 40 is removably attachable to the other end of the second compartment 30.

Figure 3:
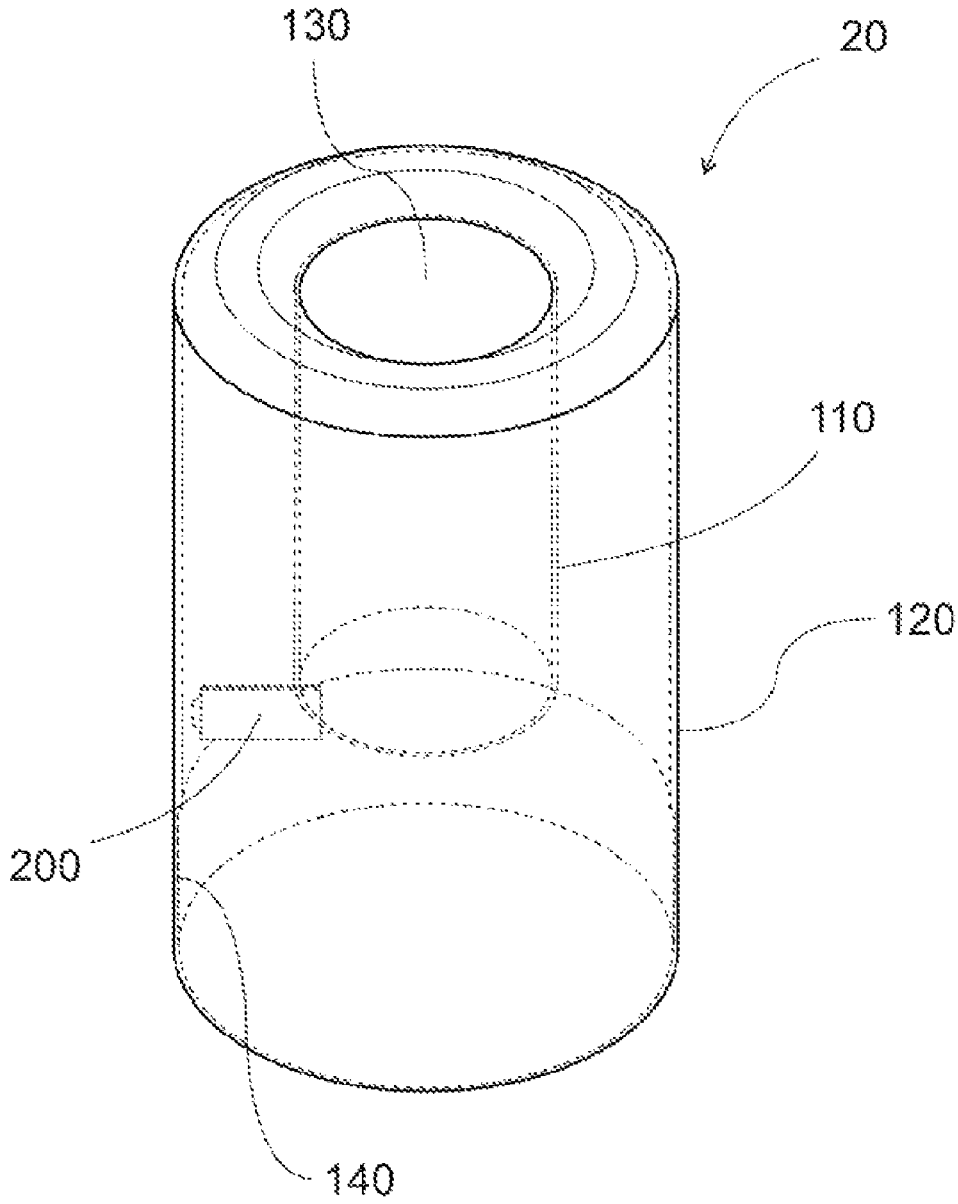
FIG. 3 is a transparent, perspective view of a first compartment of the embodiment shown in FIGS. 1 and 2.
Figure 6A:
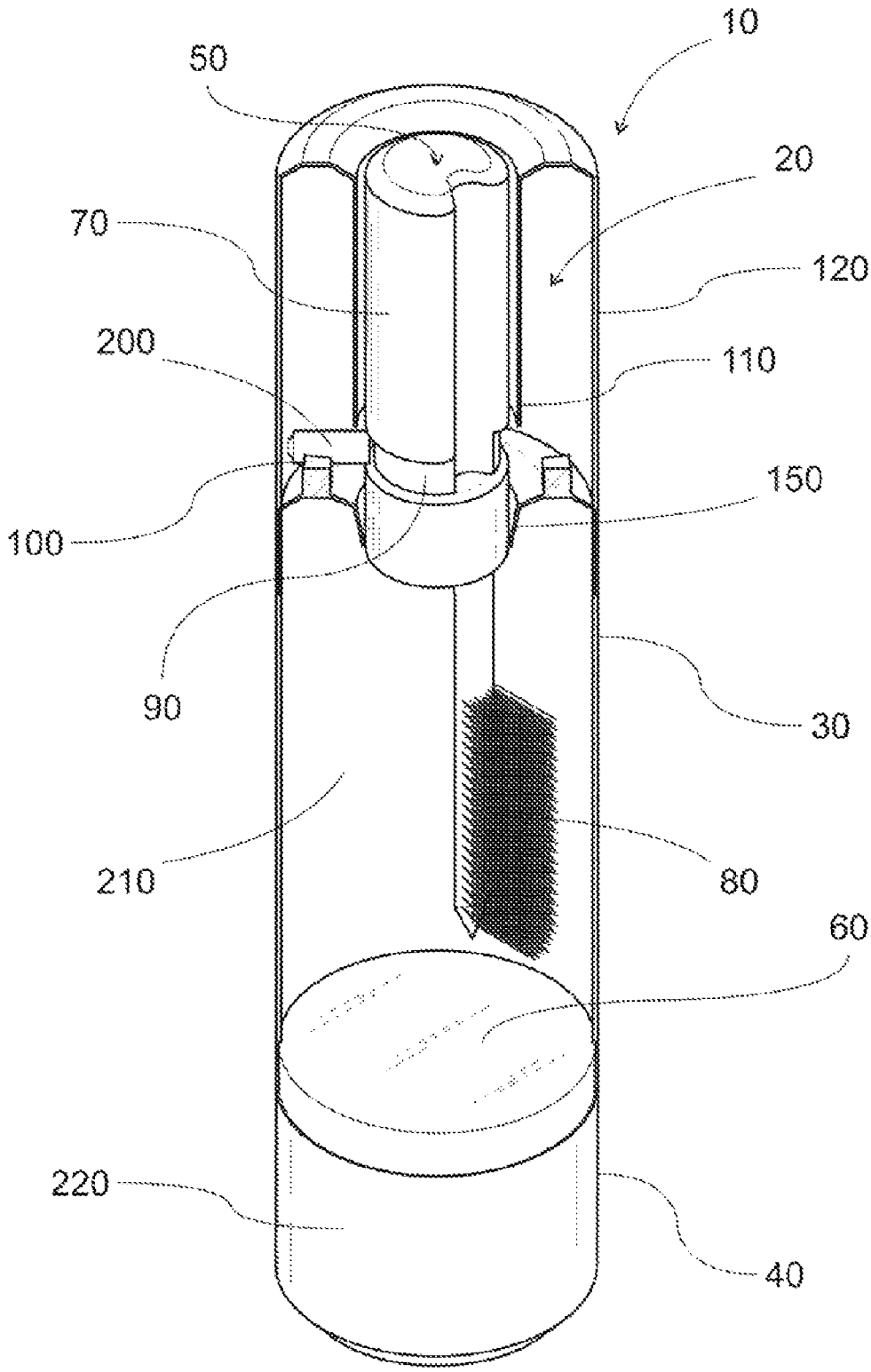
FIG. 6A illustrates the embodiment shown in FIG. 1 with a cross-sectional view of the first compartment and the second compartment of the embodiment, which is taken at S-S from FIG. 1, wherein a brush applicator is in a locked position.

The first compartment 20 comprises an inner layer 110 and an outer layer 120, and the inner layer 110 defines an aperture 130 to receive the brush applicator 50 in the aperture 130. As shown in FIGS. 3 and 6A, the length of the inner layer 110 is smaller than the length of the outer layer 120 so that a locking member 200 can extend from the outer layer 120, passing under the inner layer 110. The locking member 200 can be separately manufactured and pressed into the first compartment 20 to be attached thereto. Alternatively, the locking member 200 can be an integral part of the first compartment 20.

Figure 4:
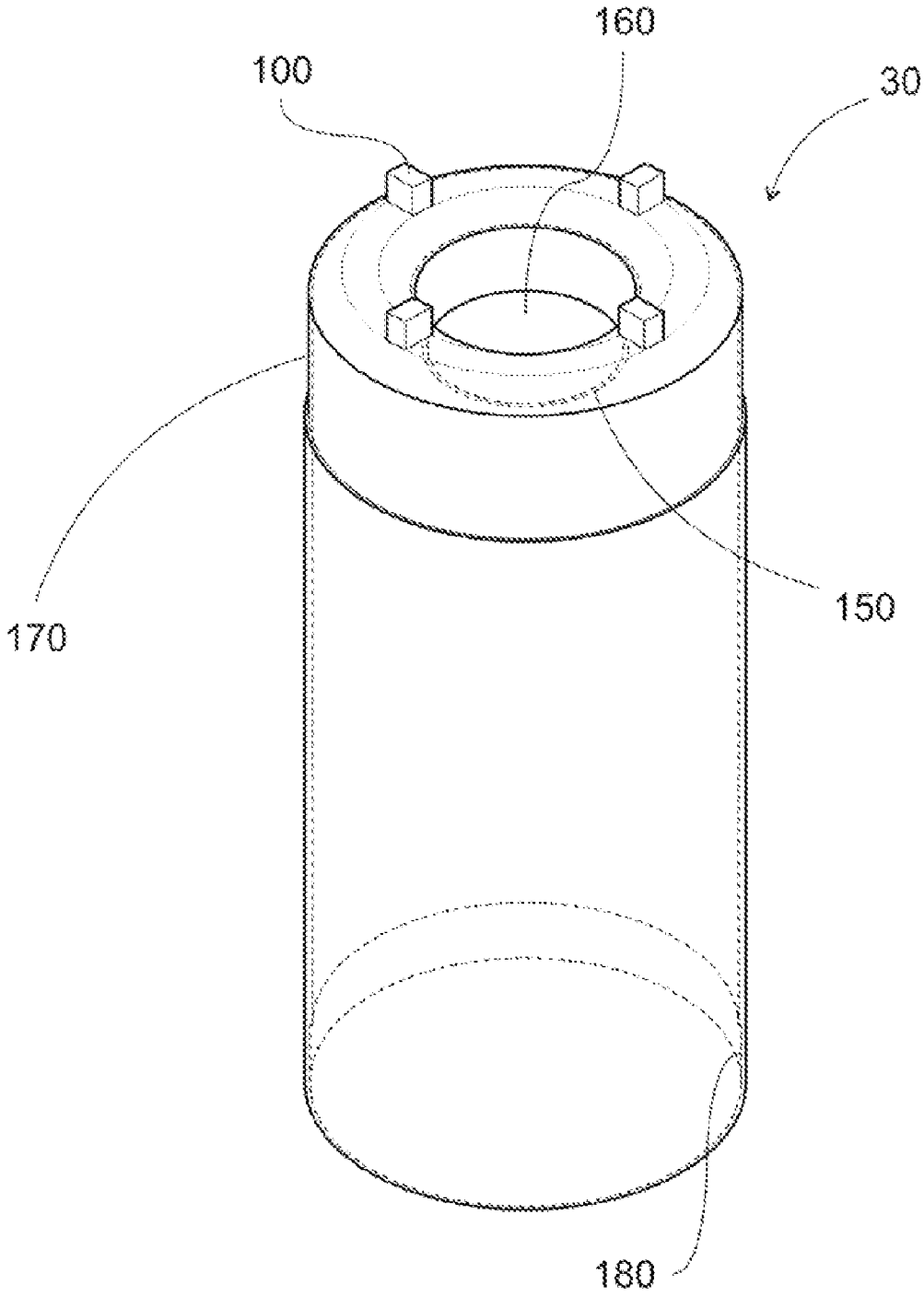
FIG. 4 is a transparent, perspective view of a second compartment of the embodiment shown in FIGS. 1 and 2.
Figure 5:
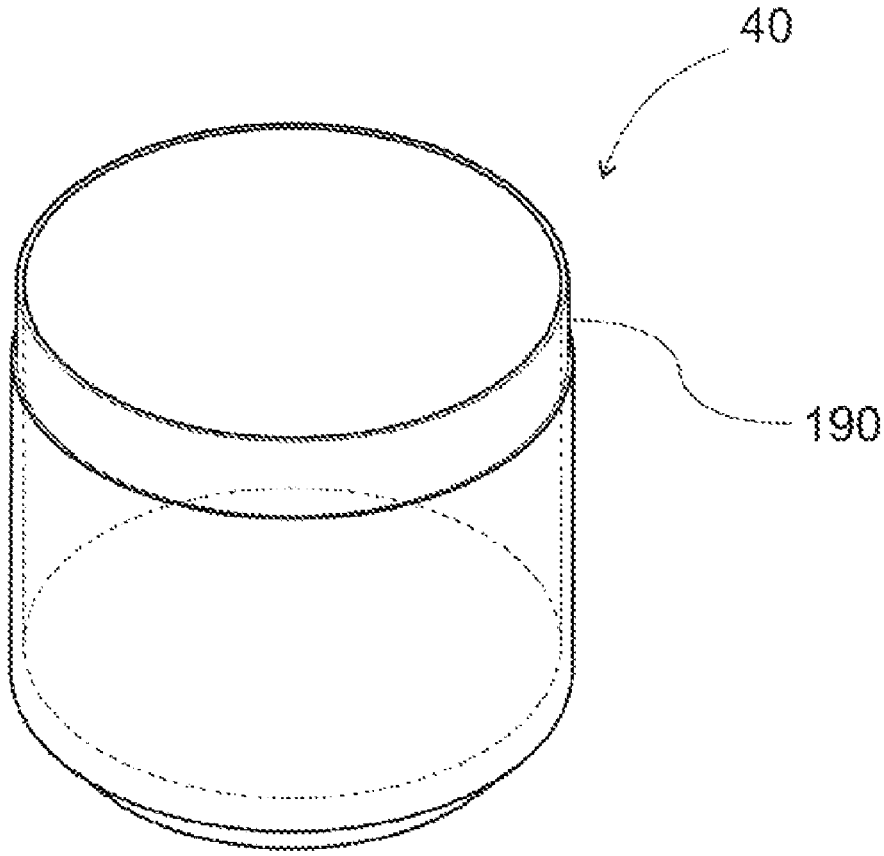
FIG. 5 is a transparent, perspective view of a third compartment of the embodiment shown in FIGS. 1 and 2.
Figure 7:
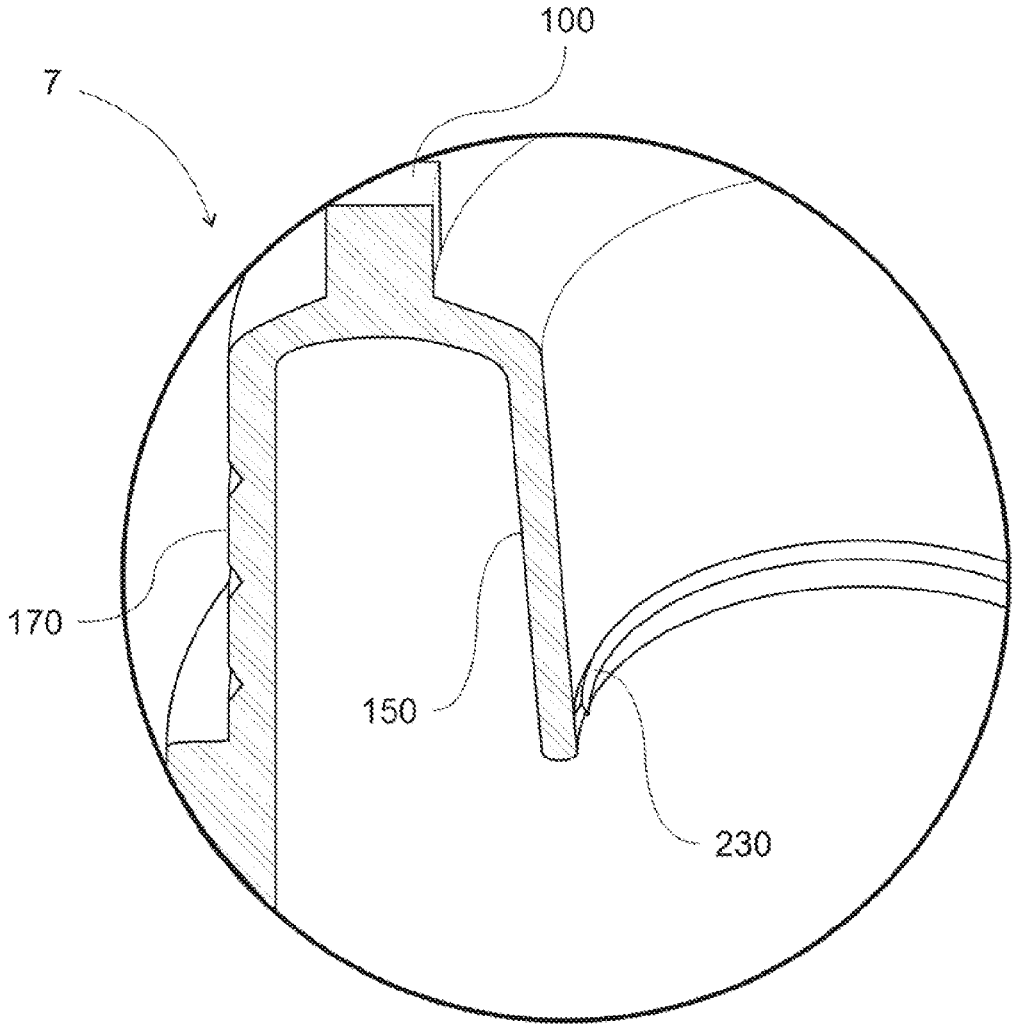
FIG. 7 is an enlarged perspective view of an area as indicated by arrow 7 in FIG. 6F.

The second compartment 30 comprises at least one projecting element 100 formed on a top surface of the second compartment 30. FIG. 4 shows an example where four projecting elements 100 are located on the top surface of the second compartment 30 at uniform intervals. The second compartment 30 further comprises an inner skirt 150 formed inwardly from the top surface of the second compartment 30. The inner skirt 150 defines an opening 160 to receive the brush applicator 50. As illustrated in FIG. 7, a lip 230 is formed on the inner skirt 150 of the second compartment 30 so as to tightly seal any gap between the inner skirt 150 and the brush applicator 50. The lip 230 may be in a substantially inverse V shape and is thin and flexible enough to allow the brush applicator 50 to move in and out through the opening 160.

A bottom portion 140 of the first compartment 20 and a top portion 170 of the second compartment 30 are configured such that the bottom portion 140 of the first compartment 20 can engage the top portion 170 of the second compartment 30 so as to be removably attached to the second compartment 30. For example, the inner diameter of the bottom portion 140 of the first compartment 20 may be larger than the inner diameter of an upper portion of the first compartment 20, and the outer diameter of the top portion 170 of the second compartment 30 may be smaller than the outer diameter of a lower portion of the second compartment 30, where the inner diameter of the bottom portion 140 of the first compartment 20 is substantially the same as the outer diameter of the top portion 170 of the second compartment 30. In such structure, the top portion 170 of the second compartment 30 can fit into and frictionally engage the bottom portion 140 of the first compartment 20 so that the first compartment 20 is attached to the second compartment 30. As another example, the first compartment 20 may comprise female threads, and the second compartment 30 may comprise male threads that correspond to the female threads of the first compartment 20 such that the male threads of the second compartment 30 can screw into the female threads of the first compartment 20.

Similarly, a bottom portion 180 of the second compartment 30 and a top portion 190 of the third compartment 40 are configured such that the bottom portion 180 of the second compartment 30 can engage the top portion 190 of the third compartment 40 so as to be attached to the third compartment 40. For example, the inner diameter of the bottom portion 180 of the second compartment 30 may be larger than the inner diameter of an upper portion of the second compartment 30, and the outer diameter of the top portion 190 of the third compartment 40 may be smaller than the outer diameter of a lower portion of the third compartment 40, where the inner diameter of the bottom portion 180 of the second compartment 30 is substantially the same as the outer diameter of the top portion 190 of the third compartment 40. In such structure, the top portion 190 of the third compartment 40 can fit into and frictionally engage the bottom portion 180 of the second compartment 30 so that the third compartment 40 is attached to the second compartment 30. In another example, the second compartment 30 may comprise female threads, and the third compartment 40 may comprise male threads that correspond to the female threads of the second compartment 30 such that the male threads of the third compartment 40 can screw into the female threads of the second compartment 30. Alternatively, the third compartment 40 may be integrally connected to the second compartment 30 such that the third compartment 40 is not detachable from the second compartment 30.

The brush applicator 50 comprises a handle 70 and a brush 80, and a recess 90 is formed on the handle 70 of the brush applicator 50. The brush 80 extends from the handle 70 such that the brush 80 is off-centered or situated away from the center of the handle 70.

FIG. 6A shows that the brush applicator 50 is in a locked position, in which the locking member 200 protruding from an inside surface of the outer layer 120 of the first compartment 20 engages the recess 90 formed on the handle 70 of the brush applicator 50. Due to the locking member 200 engaging the recess 90, the brush applicator 50 cannot be pressed down as well as cannot slip out of the device 10. In the locked position, the handle 70 of the brush applicator 50 is located in the aperture 130 of the first compartment 20, and the brush 80 of the brush applicator 50 is located in the second compartment 30 through the opening 160 of the second compartment 30. A low-end portion of the handle 70 of the brush applicator 50 engages the inner skirt 150 of the second compartment 30, and the lip 230 formed on the inner skirt 150 tightly seals any gap between the inner skirt 150 and the low-end portion of the handle 70 of the brush applicator 50. The second compartment 30 contains a first hair coloring chemical 210, and the third compartment 40 contains a second hair coloring chemical 220. The first hair coloring chemical 210 may be a developer or oxidizing agent, and the second hair coloring chemical 220 may be a color. The membrane 60 is located between the second compartment 30 and the third compartment 40 such that the first hair coloring chemical 210 is separated from the second hair coloring chemical 220 by the membrane 60.

The membrane 60 is installed in the device 10 under tension. The membrane 60 may be attached to the top portion 190 of the third compartment 40 by glue, heat, or any other similar adhesives or attachment methods, and the third compartment 40 with the membrane 60 attached thereto is connected to the second compartment 30, thereby placing the membrane 60 in the device 10. In another embodiment, the membrane 60 may be placed on top of the third compartment 40 without utilizing any adhesives or attachment methods and can be mechanically installed in the device 10 by pressing the top portion 190 of the third compartment 40 into the bottom portion 180 of the second compartment 30. In still another embodiment, the membrane 60 may be attached to an inner surface of the second compartment 30 by glue, heat, or any other similar adhesives or attachment methods in proximity to the bottom portion 180 of the second compartment 30.

The membrane 60 can be made of a material that is substantially resistant to hydrogen peroxide attack and allows nearly complete retraction of the membrane upon puncture. For example, the membrane 60 may be made of a low-creep moldable thermoplastic elastomeric polymer, such as polyolefin blends, elastomeric alloys, thermoplastic polyurethanes, and thermoplastic copolyesters. As another example, the membrane 60 may be made of silicone.

Each of the second compartment 30 and the third compartment 40 may be made of a material that is substantially chemical resistant and suitable for holding a hair coloring chemical making skin contact under FDA standard. For example, the second compartment 30 and the third compartment 40 may be made of polypropylene, polyethylene terephthalate, High-density polyethylene (HDPE), polycarbonate, or polyvinyl chloride.

FIGS. 6A through 6F illustrate a method of using the device 10 to mix and apply hair coloring chemicals to a user's hair. As explained above and shown in FIG. 6A, the first hair coloring chemical 210 and the second hair coloring chemical 220 are contained in the second compartment 30 and the third compartment 40 respectively such that the first hair coloring chemical 210 is separated from the second hair coloring chemical 220 by the membrane 60. The brush applicator 50 is in a locked position, in which the locking member 200 protruding from an inside surface of the outer layer 120 of the first compartment 20 engages the recess 90 formed on the handle 70 of the brush applicator 50. When the locking member 200 engages the recess 90, the brush applicator 50 cannot be pressed down as well as cannot slip out of the device 10. In the locked position, the brush applicator 50 is located above the membrane 60 and does not contact the membrane 60.

Figure 6B:
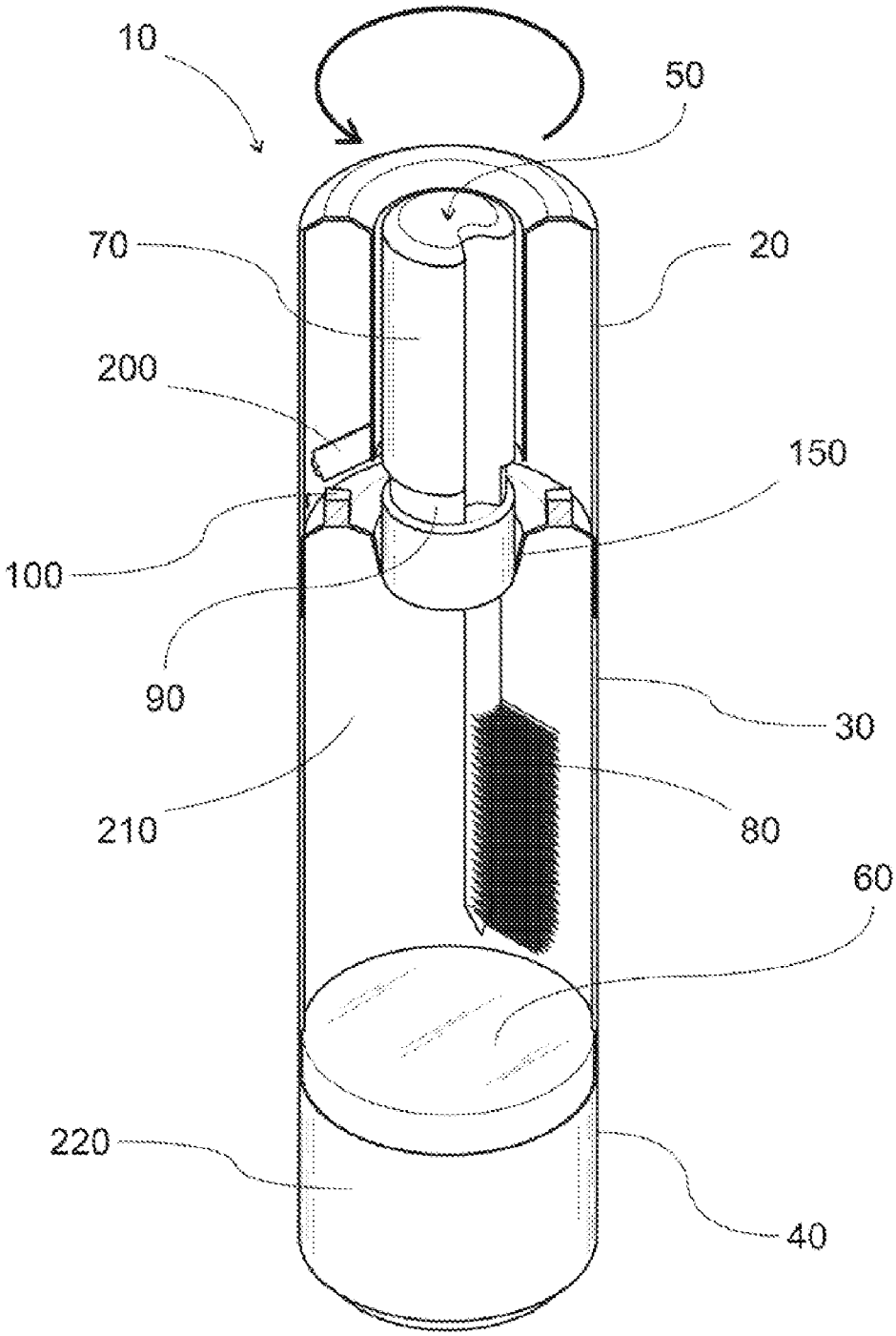
FIG. 6B illustrates the embodiment shown in FIG. 1 with a cross-sectional view of the first compartment and the second compartment of the embodiment, which is taken at S-S from FIG. 1, wherein a locking member is snapped off by rotation of the first compartment.
Figure 6C:
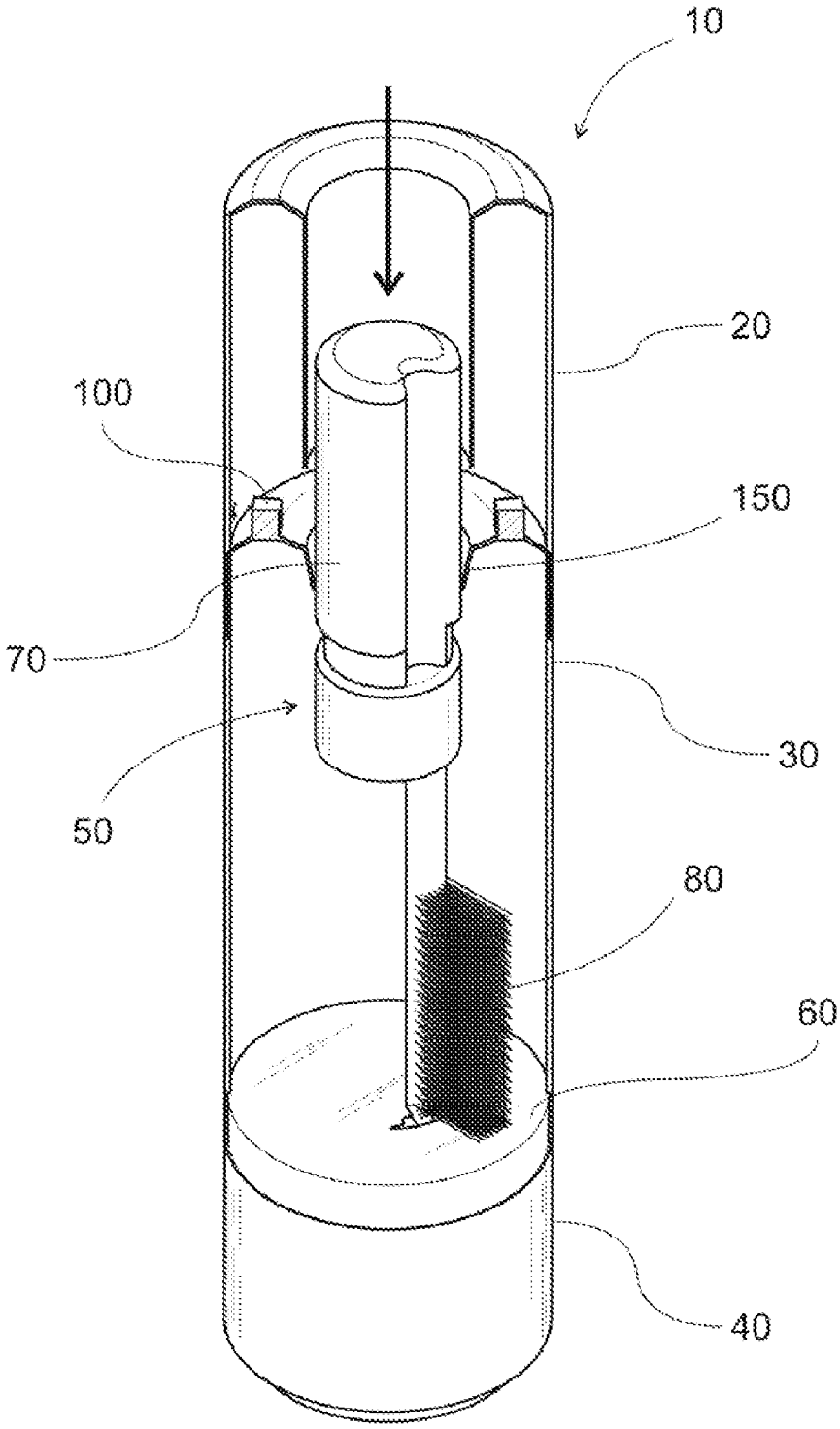
FIG. 6C illustrates the embodiment shown in FIG. 1 with a cross-sectional view of the first compartment and the second compartment of the embodiment, wherein the brush applicator is pressed toward a membrane to puncture the membrane.
Figure 6D:
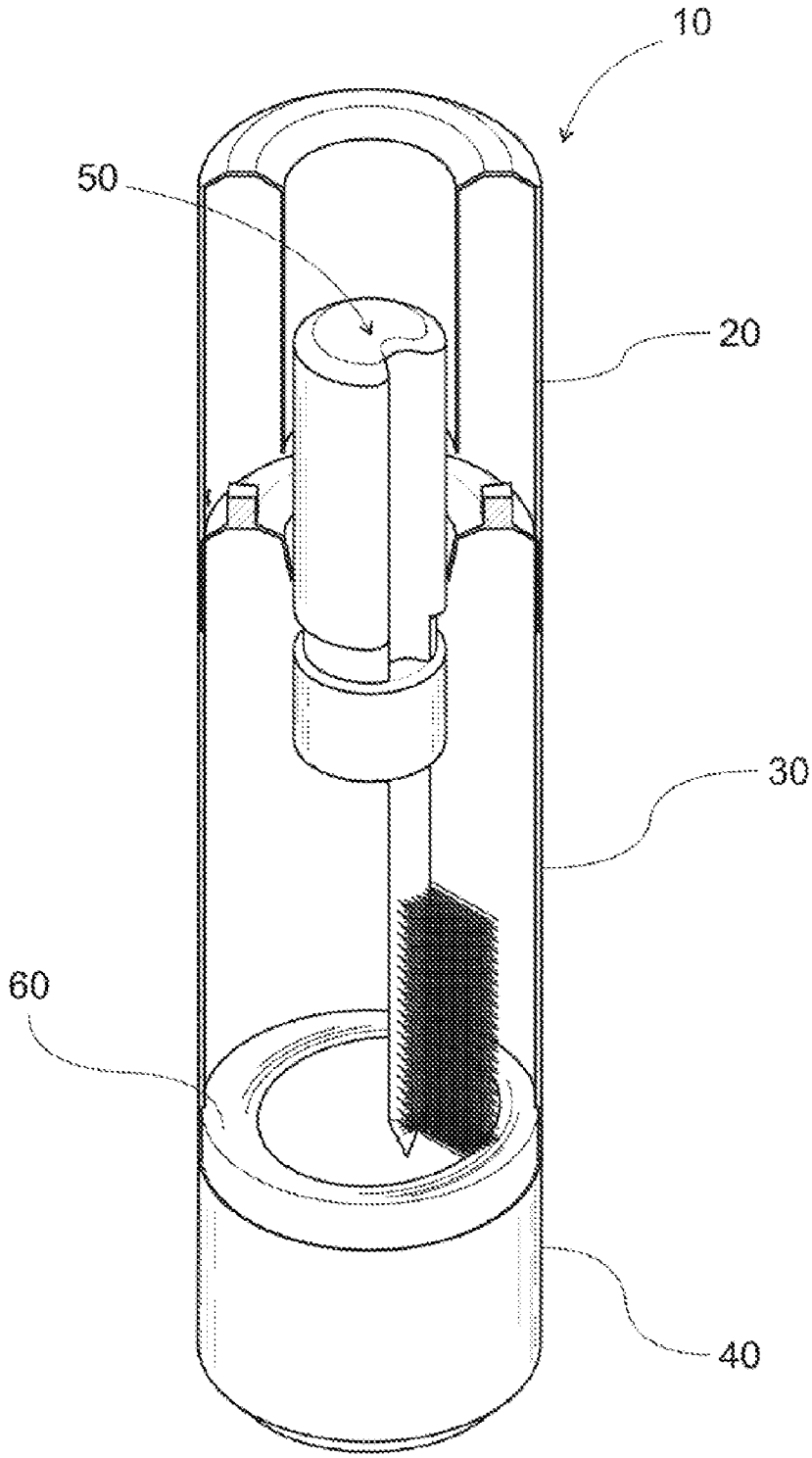
FIG. 6D illustrates the embodiment shown in FIG. 1 with a cross-sectional view of the first compartment and the second compartment of the embodiment, wherein the membrane retracts to a peripheral edge of the membrane.
Figure 6E:
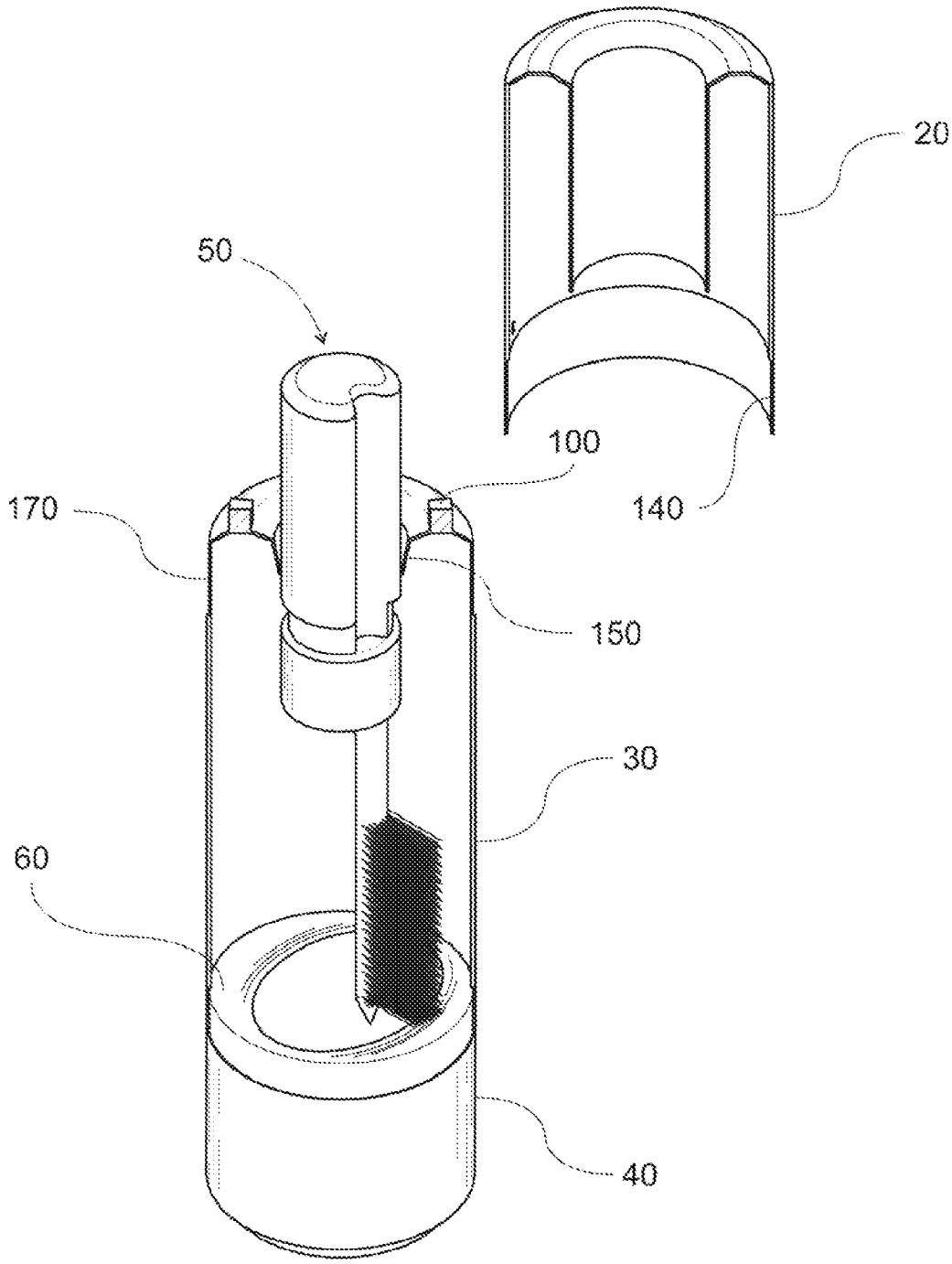
FIG. 6E illustrates the embodiment shown in FIG. 1 with a cross-sectional view of the first compartment and the second compartment of the embodiment, wherein the first compartment is removed from the second compartment.

As shown in FIG. 6B, when a user rotates the first compartment 20 relative to the second compartment 30, the locking member 200 collides against the projecting element 100 and is snapped off. As a consequence, the brush applicator 50 is released from the locked position since the locking member 200 no longer engages the recess 90 of the brush applicator 50. The brush applicator 50 is now movable toward the membrane 60, and, as illustrated in FIG. 6C, the user presses the brush applicator 50 toward the membrane 60. When the brush applicator 50 is pressed, a terminus of the brush applicator 50 contacts and punctures the membrane 60. The terminus of the brush applicator 50 may be sharp enough to easily puncture the membrane 60. Upon puncture, the membrane 60 retracts to a peripheral edge of the membrane 60 so that the first hair coloring chemical 210 and the second hair coloring chemical 220 are mixed together. In order to facilitate mixing the first hair coloring chemical 210 and the second hair coloring chemical 220, the user may shake the device 10 after the retraction of the membrane 60.

Figure 6F:
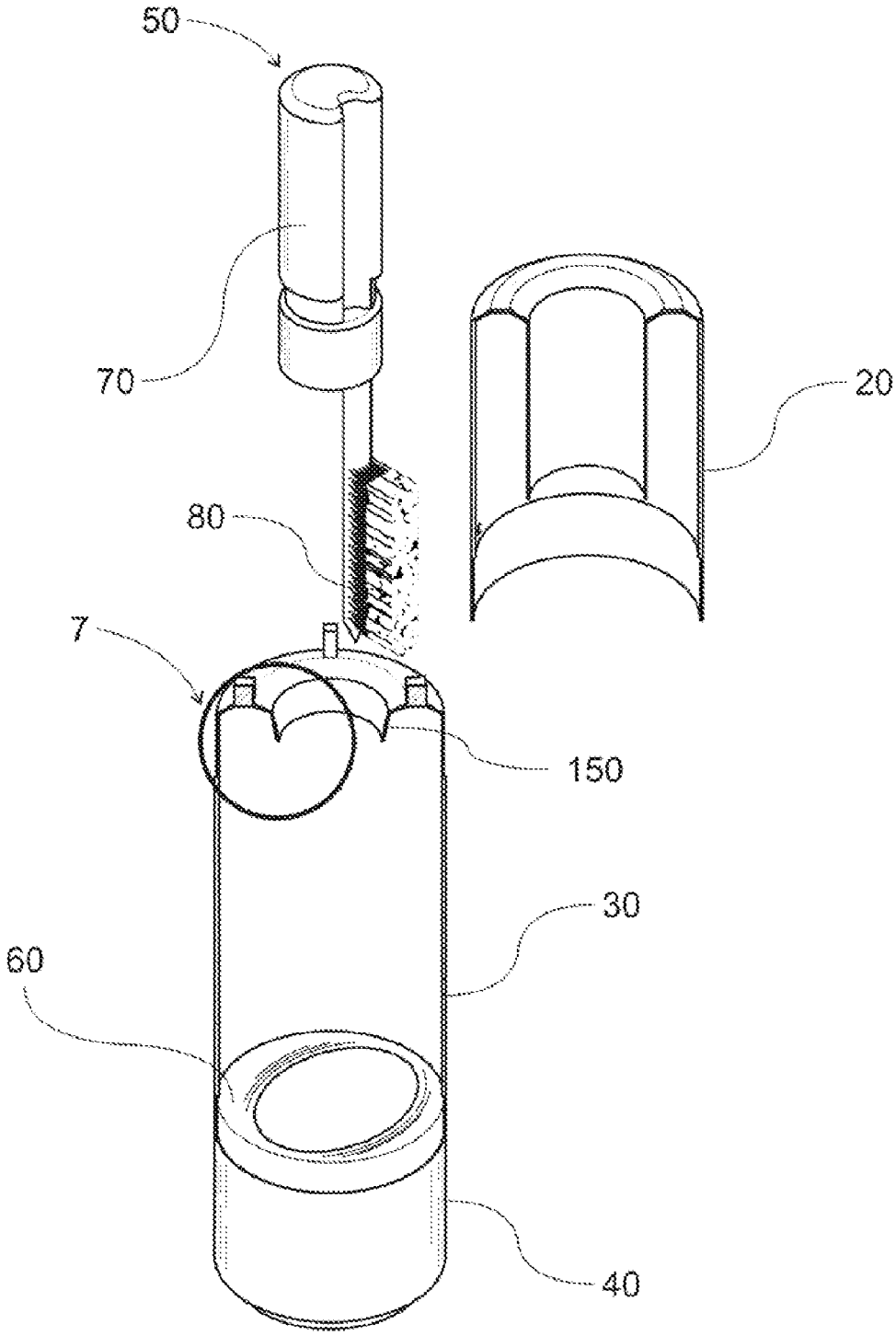
FIG. 6F illustrates the embodiment shown in FIG. 1 with a cross-sectional view of the first compartment and the second compartment of the embodiment, wherein the brush applicator picks up mixed hair coloring chemicals as it is removed from the second compartment and the third compartment.

After the locking member 200 is snapped off, the first compartment 20 may be removed from the second compartment 30 so that the user can scoop the mixed hair coloring chemicals out of the device using the brush applicator 50. The first compartment 20 can be removed before or after the brush applicator 50 is pressed toward the membrane 60 to puncture the membrane 60. The user scoops the mixed hair coloring chemicals out of the device using the brush applicator 50 as shown in FIG. 6F, and combs his/her hair by the brush applicator 50 to apply the mixed hair coloring chemicals to his/her hair.

The above construction and properties of the device 10 allow a user to easily store hair coloring chemicals and carry them in the device 10 without a spillage of the chemicals during travel so that the user mixes and applies the hair coloring chemicals to his/her hair at any time and at any place.

Figure 8:
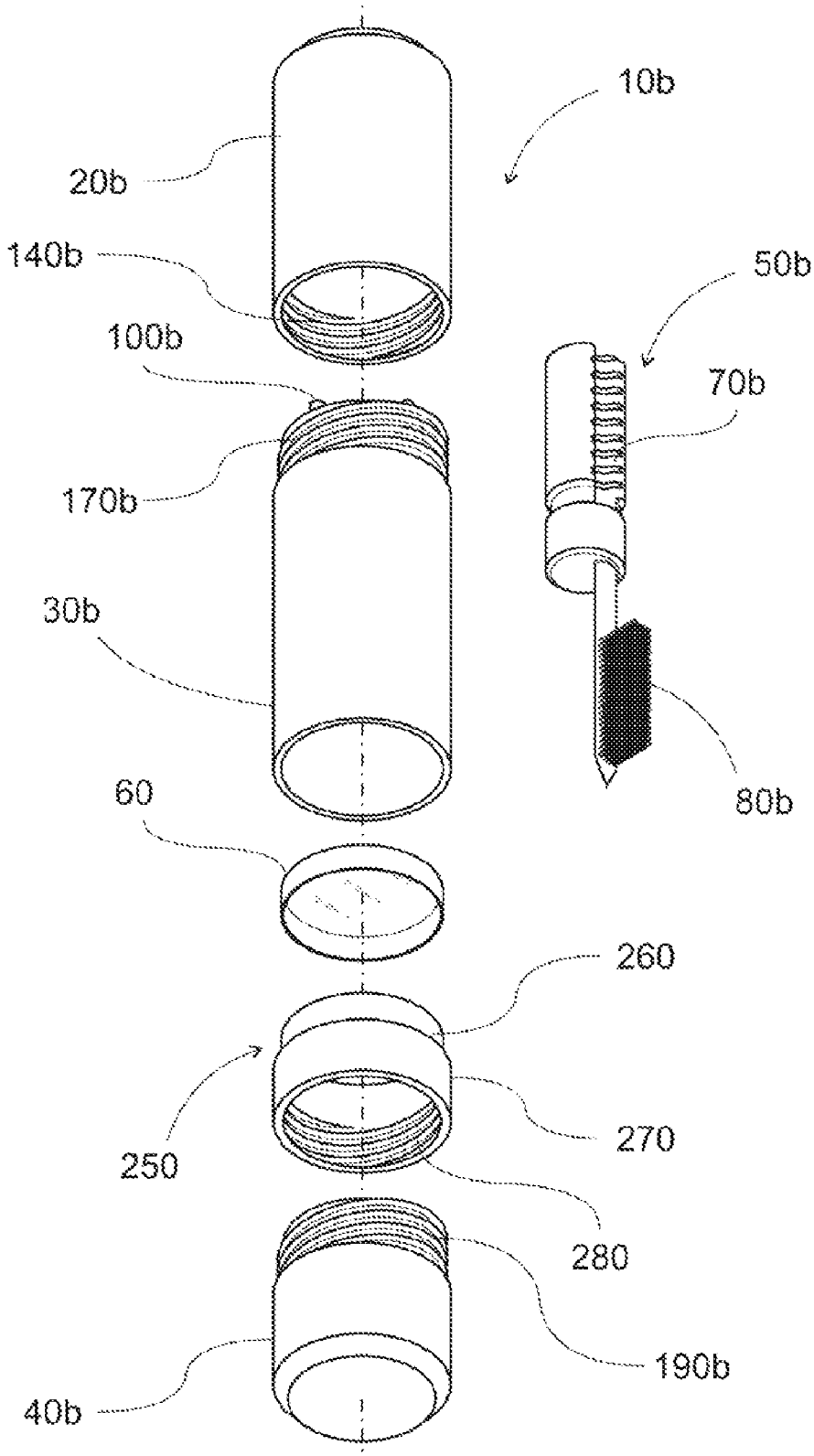
FIG. 8 is a perspective view of another embodiment of the present invention, showing that structural elements thereof are disassembled.
Figure 9:
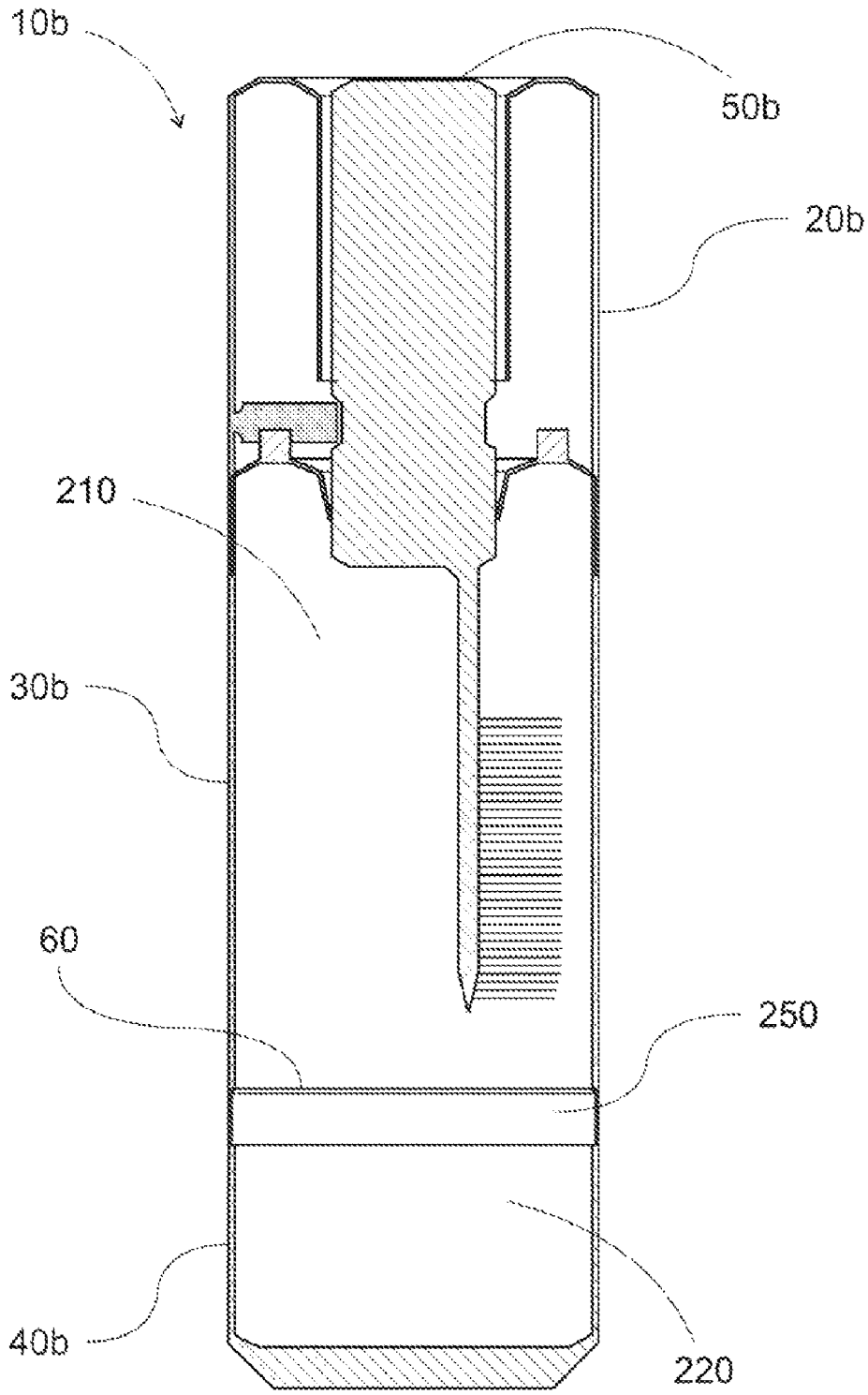
FIG. 9 is a cross-sectional view of the embodiment shown in FIG. 10, showing that all structural elements thereof are assembled.

FIGS. 8 and 9 illustrate another embodiment of the present invention. The embodiment shown in FIGS. 8 and 9 further comprises a connector 250. The connector 250 comprises an upper portion 260 and a lower portion 270, and the membrane 60 is attachable to the upper portion 260 of the connector 250 by glue, heat, or any other similar adhesives or attachment methods. The upper portion 260 of the connector 250 is configured to fit into and engage a bottom portion of the second compartment 30*b* so that the membrane 60 can be placed in the device 10*b*. The lower portion 270 of the connector 250 comprises female threads 280, and the third compartment 40*b* comprises male threads 190*b*. The male threads 190*b* of the third compartment 40*b* correspond to the female threads 280 of the connector 250 such that the male threads 190*b* of the third compartment 40*b* can screw into the female threads 280 of the connector 250 so that the third compartment 40*b* is removably attachable to the connector 250. Other than the use of the connector 250, the construction and features utilized in the embodiment shown in FIGS. 1 through 7 can apply to the remaining structure of the embodiment shown in FIGS. 8 and 9.

Since the third compartment 40*b* is removably attachable to the connector 250, the device 10*b* containing a developer in the second compartment 30*b* can be manufactured first with an empty third compartment 40*b*, and a user or a stylist at a salon can later select any desired color, put it in the third compartment 40*b*, and attach the third compartment 40*b* containing the desired color to the device by screwing the third compartment 40*b* into the connector 250. It enables a manufacturer to massively manufacture the device 10*b* containing a developer with an empty third compartment 40*b* because a developer is commonly required regardless of what color a user or a stylist would choose.

In order to use the device 10*b*, a user or a stylist detaches the third compartment 40*b* from the device 10*b* if the device 10*b* is provided with an empty third compartment 40*b* attached thereto. The user or stylist prepares a custom color desired, puts it in the third compartment 40*b*, and attaches the third compartment 40*b* containing the desired color to the device by screwing the third compartment 40*b* into the connector 250. The remaining steps are the same as those in the embodiment shown in FIGS. 1 through 7: a user rotates the first compartment 20*b* relative to the second compartment 30*b* so that the locking member collides against the projecting element 100*b* and is snapped off. The user presses the brush applicator 50*b* toward the membrane 60 so that a terminus of the brush applicator 50*b* contacts and punctures the membrane 60. Upon puncture, the membrane 60 retracts to a peripheral edge of the membrane 60 so that the developer and the custom color are mixed together. In order to facilitate mixing the developer and the custom color, the user may shake the device 10*b* after the retraction of the membrane 60. After the locking member is snapped off, the first compartment 20*b* may be removed from the second compartment 30*b* so that the user can scoop the mixed hair coloring chemicals out of the device using the brush applicator 50*b*. The first compartment 20*b* can be removed before or after the brush applicator 50*b* is pressed toward the membrane 60 to puncture the membrane 60. The user scoops the mixed hair coloring chemicals out of the device using the brush applicator 50*b* and combs his/her hair by the brush applicator 50*b* to apply the mixed hair coloring chemicals to his/her hair.

Figure 10A:
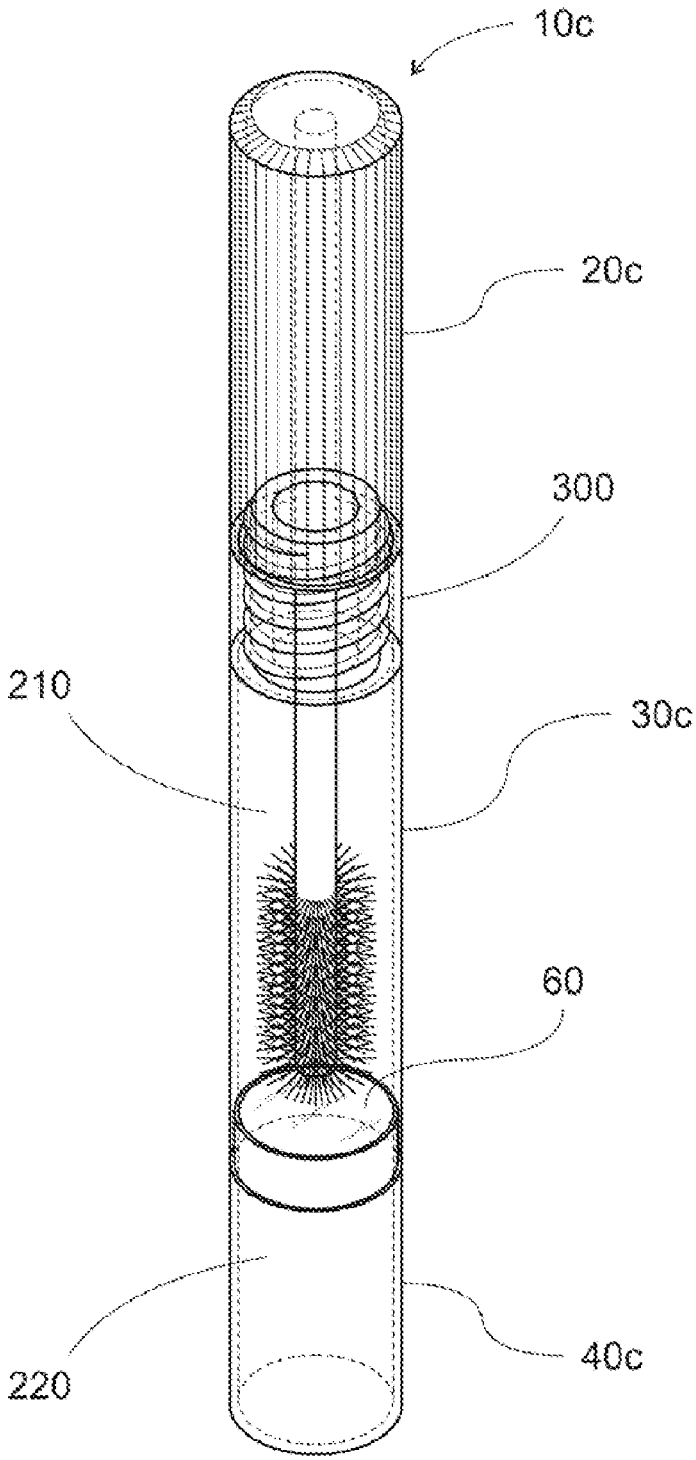
FIG. 10A is a transparent, perspective view of another embodiment of the present invention, showing that all structural elements thereof are assembled.
Figure 10B:
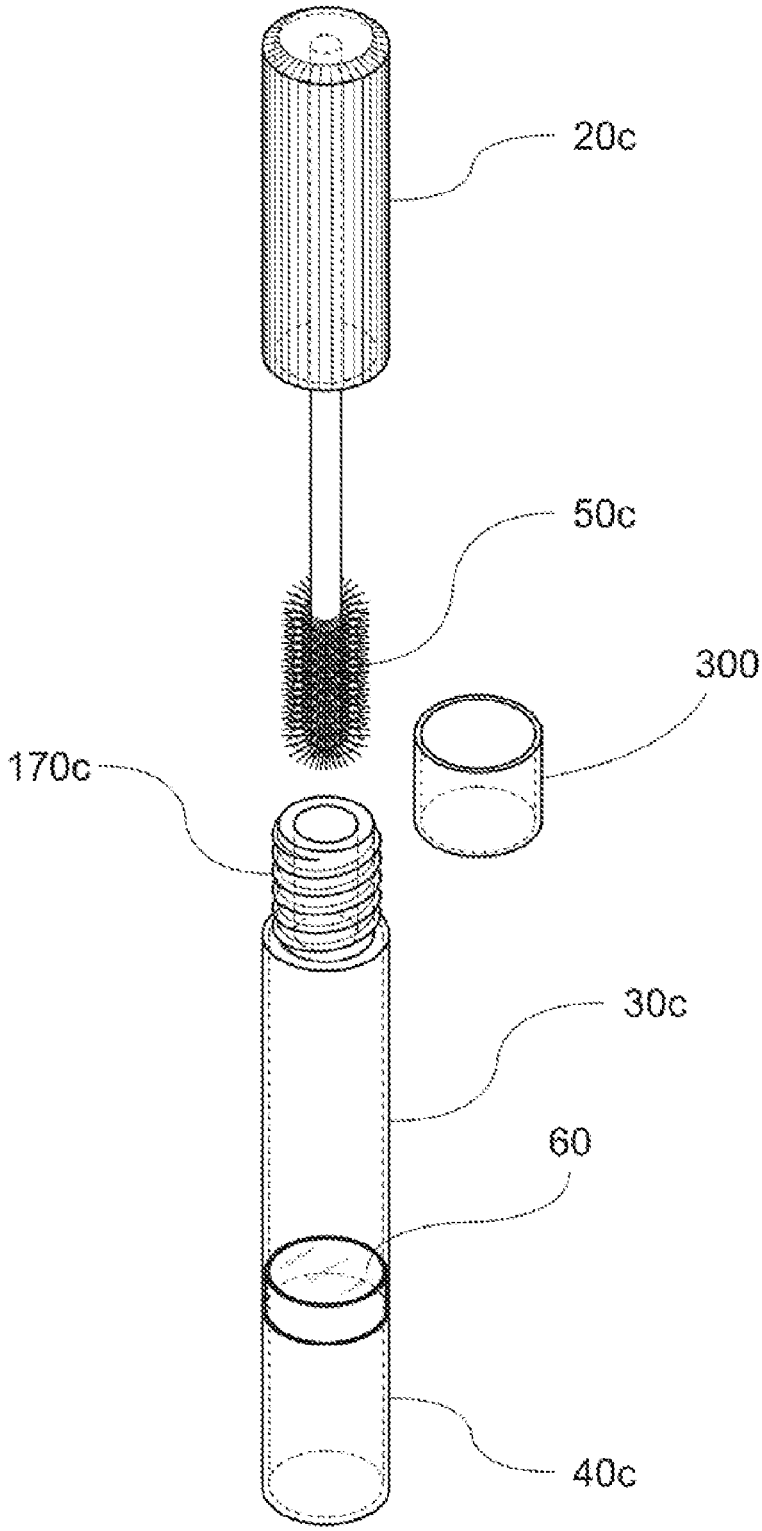
FIG. 10B is a transparent, perspective view of the embodiment shown in FIG. 12A, showing that structural elements thereof are disassembled.
Figure 11A:
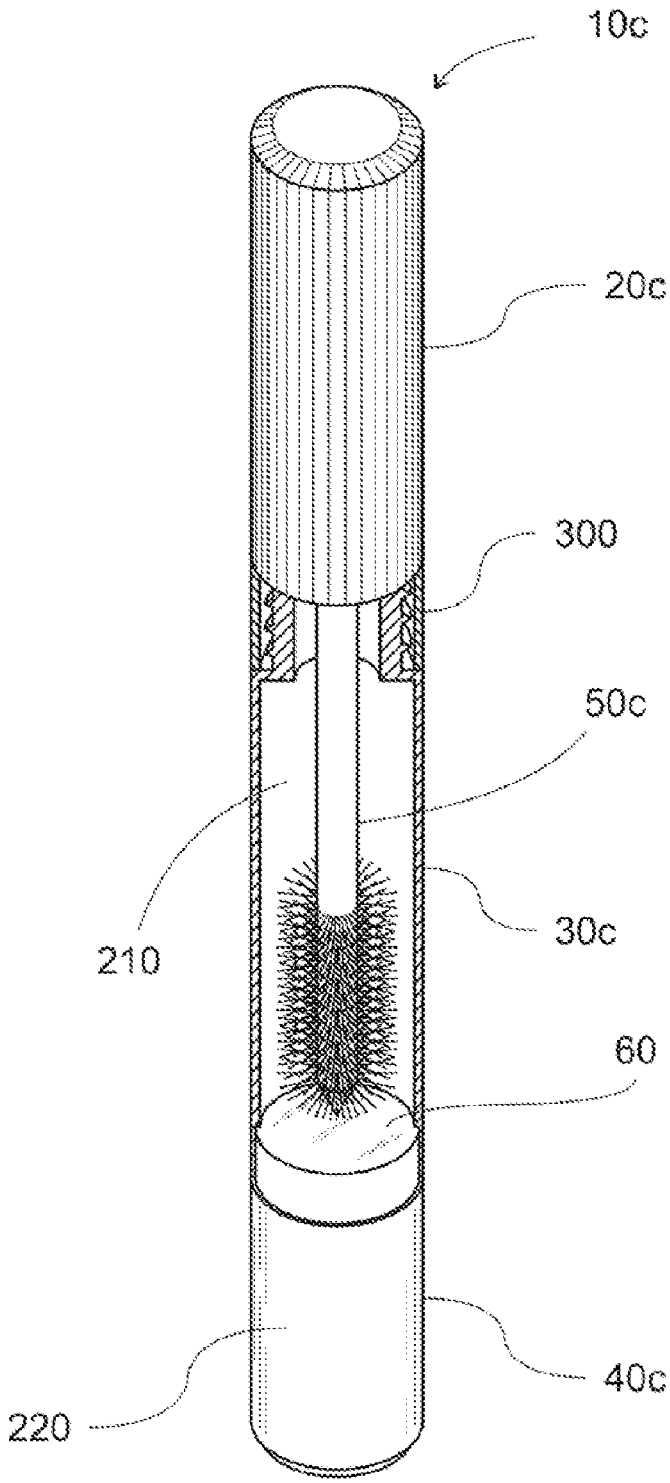
FIG. 11A illustrates the embodiment shown in FIG. 12A with a cross-sectional view of a locking member and a second compartment of the embodiment, wherein a brush applicator is in a locked position.
Figure 11B:
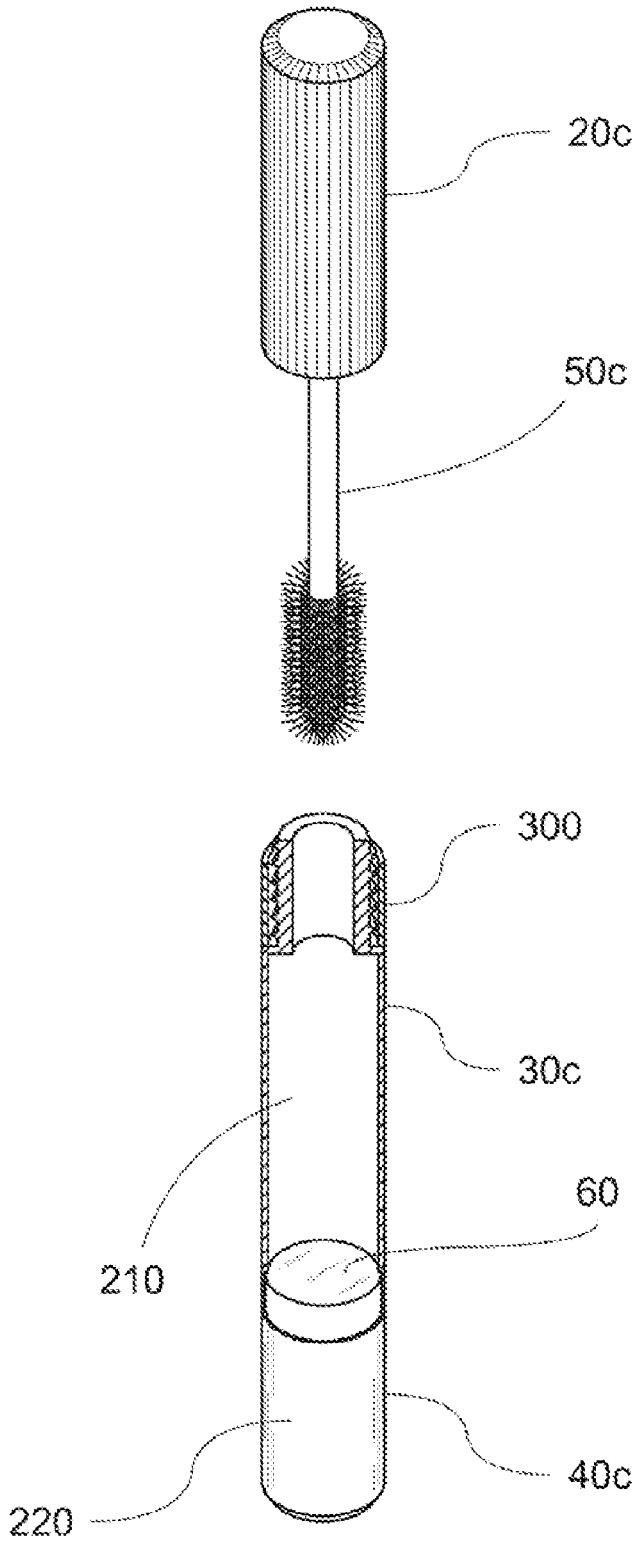
FIG. 11B illustrates the embodiment shown in FIG. 12A with a cross-sectional view of the locking member and the second compartment of the embodiment, wherein a first compartment and the brush applicator are removed from the second compartment.
Figure 11C:
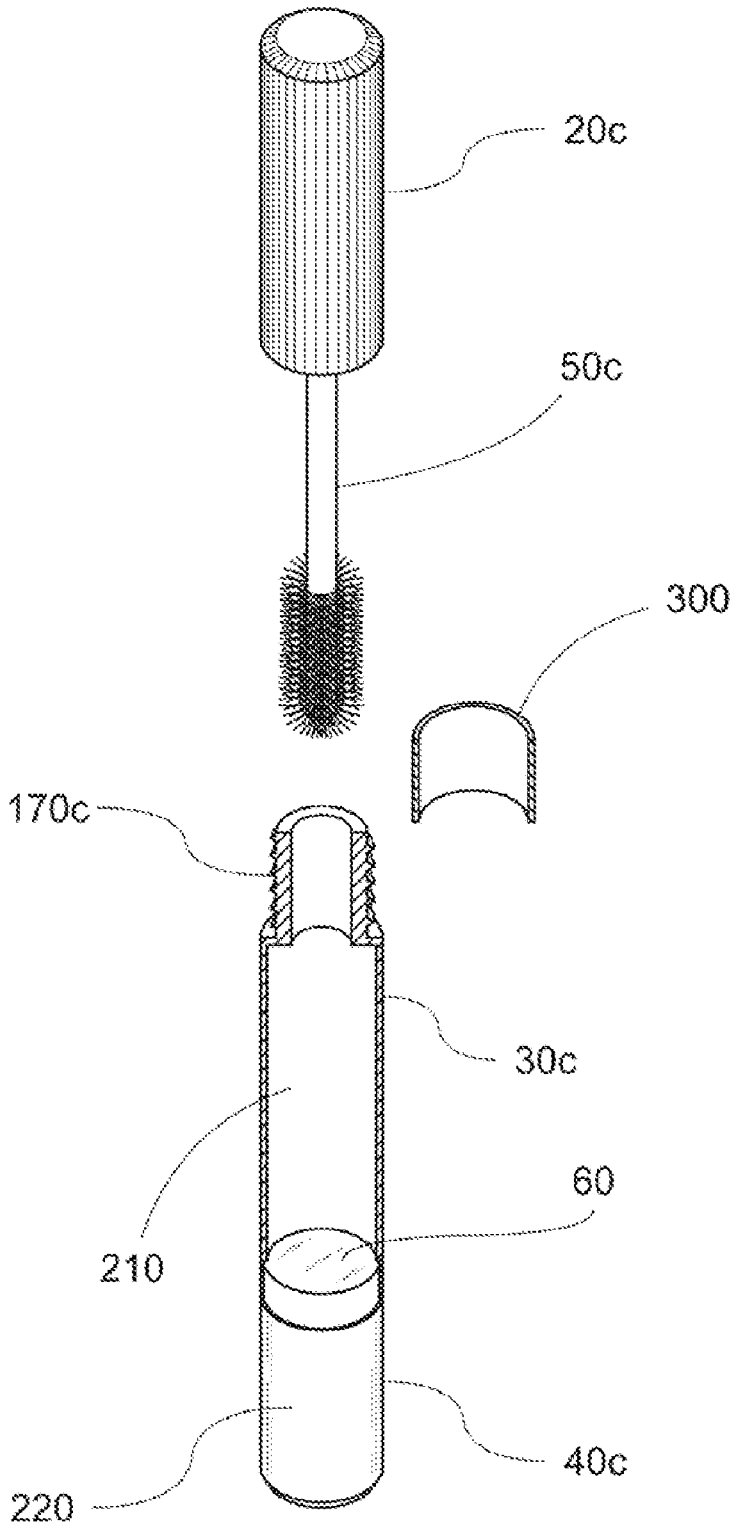
FIG. 11C illustrates the embodiment shown in FIG. 12A with a cross-sectional view of the locking member and the second compartment of the embodiment, wherein the locking member is removed from the second compartment.
Figure 11D:
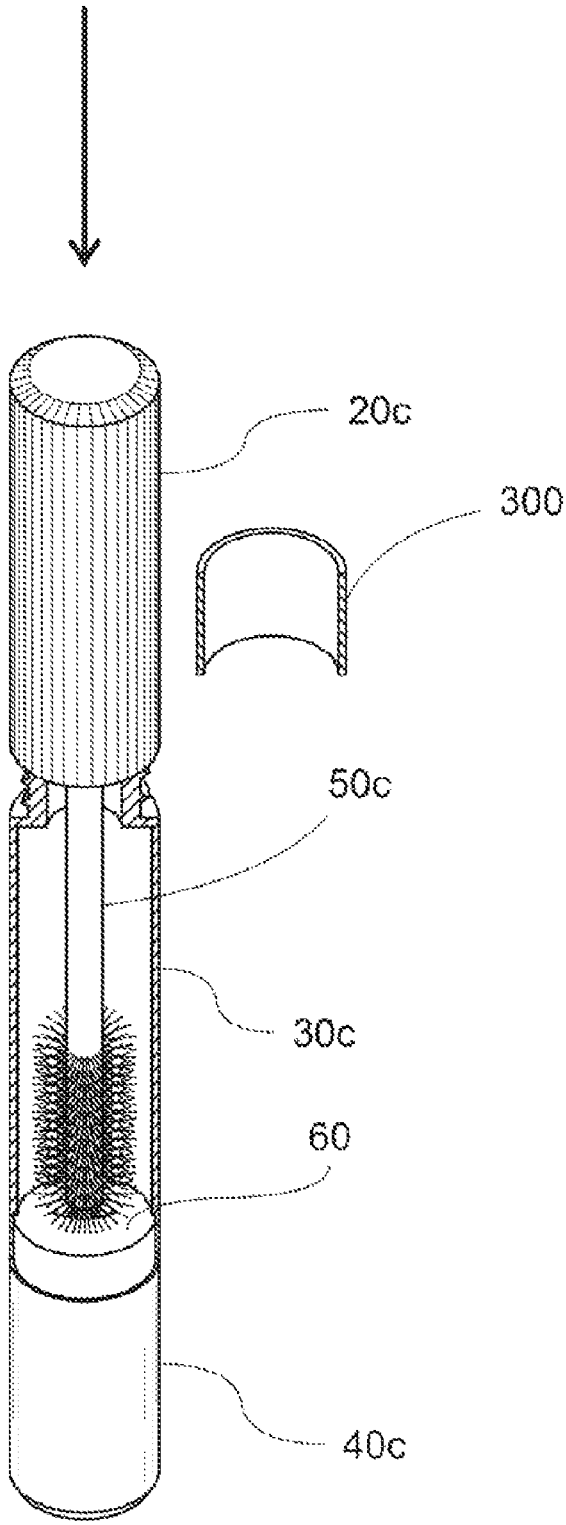
FIG. 11D illustrates the embodiment shown in FIG. 12A with a cross-sectional view of the locking member and the second compartment of the embodiment, wherein the brush applicator is moved toward a membrane to puncture the membrane.
Figure 11E:
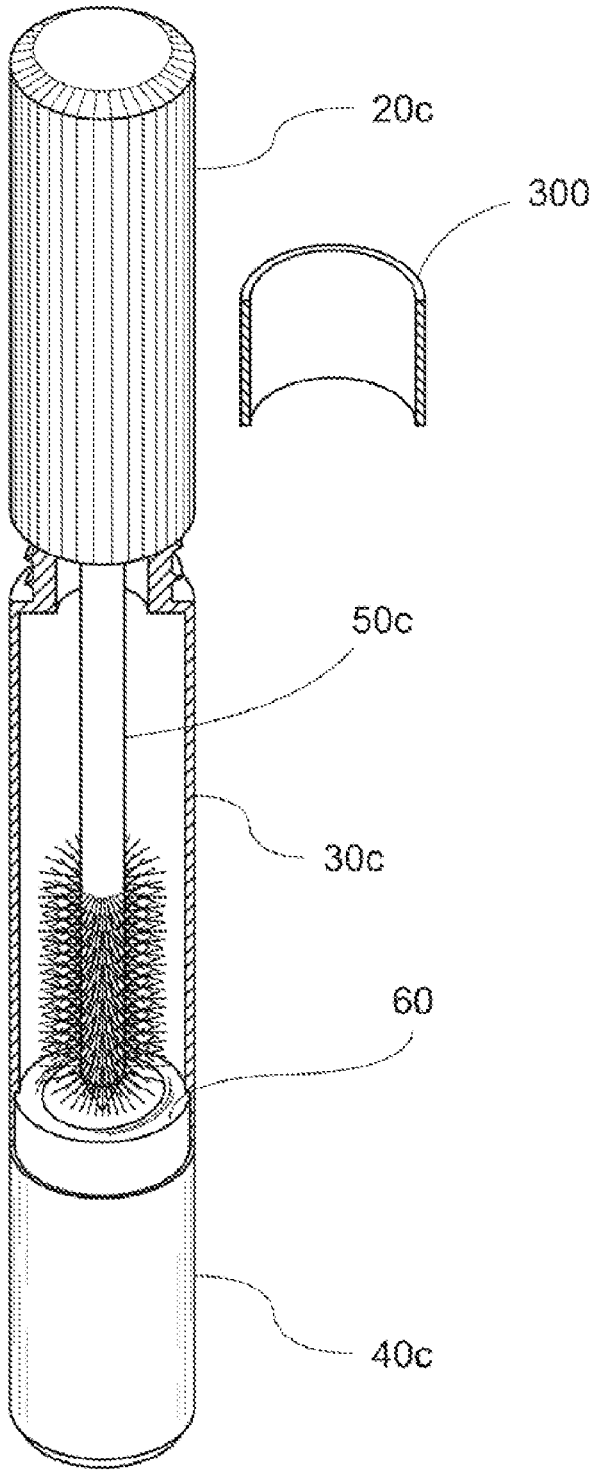
FIG. 11E illustrates the embodiment shown in FIG. 12A with a cross-sectional view of the locking member and the second compartment of the embodiment, wherein the membrane retracts to a peripheral edge of the membrane.
Figure 11F:
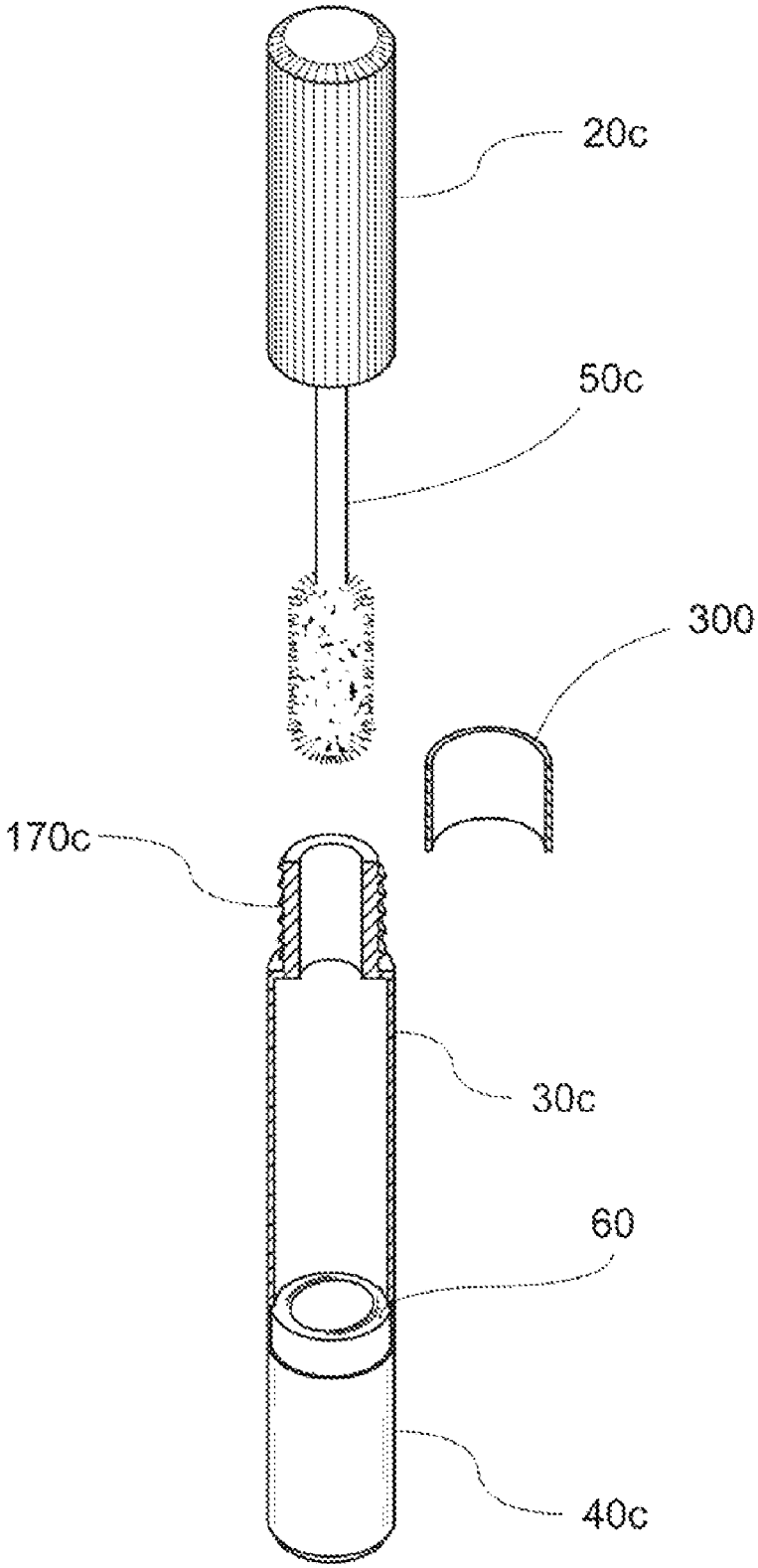
FIG. 11F illustrates the embodiment shown in FIG. 12A with a cross-sectional view of the locking member and the second compartment of the embodiment, wherein the brush applicator picks up mixed hair coloring chemicals as it is removed from the second compartment and a third compartment.

FIGS. 10 through 11F illustrate another embodiment of the present invention. A device 10*c* for mixing and applying hair coloring chemicals to a user's hair comprises a first compartment 20*c*, a second compartment 30*c*, a third compartment 40*c*, a brush applicator 50*c*, a locking member 300, and a membrane 60. The brush applicator 50*c* is attached to the first compartment 20*c*. The second compartment 30*c* comprises a male portion 170*c* configured to engage the first compartment 20*c* such that the first compartment 20*c* is removably attachable to the second compartment 30*c*. The locking member 300 is capable of removably engaging the male portion 170*c* of the second compartment 30*c*. When the locking member 300 engages the male portion 170*c* of the second compartment 30*c* as shown in FIGS. 10 and 11A, the first compartment 20*c* can engage only a first part of the male portion 170*c* and the brush applicator 50*c* is held in the locked position and does not contact the membrane 60. In the locked position, a first hair coloring chemical 210 contained in the second compartment 30*c* is separated from a second hair coloring chemical 220, which is contained in the third compartment 40*c*, by the membrane 60.

In order to use the device 10*c*, a user removes the locking member 300 from the device so that the first compartment 20*c* can engage more than the first part of the male portion 170*c* of the second compartment 30*c* to allow the brush applicator 50*c* to move toward the membrane 60 to puncture the membrane 60. If the locking member 300 has a closed-loop shape, the first compartment 20*c* may be temporarily removed before the locking member 300 can be removed, as shown in FIGS. 11B and 11C. Once the locking member 300 is removed, the first compartment 20*c* can be put back to the device to engage more than the first part of the male portion 170*c* of the second compartment 30*c*. If the locking member 300 has an open-loop shape, it may be unnecessary to remove the first compartment 20*c* before the removal of the locking member 300.

When the brush applicator 50*c* punctures the membrane 60, the membrane 60 retracts to a peripheral edge of the membrane 60 so that the first hair coloring chemical 210 and the second hair coloring chemical 220 are mixed together. In order to facilitate mixing the first hair coloring chemical 210 and the second hair coloring chemical 220, the user may shake the device 10*c* after the retraction of the membrane 60. The user scoops the mixed hair coloring chemicals out of the device using the brush applicator 50*c* as shown in FIG. 11F, and combs his/her hair by the brush applicator 50*c* to apply the mixed hair coloring chemicals to his/her hair. The first compartment 20*c* may be used also as a handle for the brush applicator 50*c* in this embodiment.

While the said detailed description elaborates workable embodiments of the present invention, the said embodiments shall not be construed as a limitation on the patented scope and claims of the present invention and, furthermore, all equivalent adaptations and modifications based on the technological spirit of the present invention shall remain protected within the scope and claims of the invention herein.

What is claimed is:

1. A device for mixing and applying hair coloring chemicals to a user's hair, the device comprising:

a brush applicator;

a first compartment capable of holding the brush applicator in a locked position;

a second compartment containing a first hair coloring chemical, the first compartment removably attachable to the second compartment;

a third compartment containing a second hair coloring chemical, the third compartment capable of being connected to the second compartment; and a membrane located between the second compartment and the third compartment such that the first hair coloring chemical is separated from the second hair coloring chemical by the membrane when the brush applicator is in the locked position, wherein the brush applicator is movable toward the membrane to puncture the membrane when the brush applicator is released from the locked position so that the membrane retracts to a peripheral edge of the membrane to cause the first hair coloring chemical and the second hair coloring chemical to be mixed together.

2. The device of claim 1, wherein the third compartment is removably attachable to the second compartment.

3. The device of claim 1, wherein the first compartment comprises an outer layer and an inner layer, the inner layer of the first compartment defining an aperture to receive the brush applicator in the aperture.

4. The device of claim 3, wherein a locking member protruding from an inside surface of the outer layer of the first compartment engages a recess formed on the brush applicator when the brush applicator is in the locked position.

5. The device of claim 4, wherein a projecting element is formed on a top surface of the second compartment such that the locking member can collide against the projecting element and be snapped off when the first compartment is rotated, the brush applicator being released from the locked position when the locking member is snapped off.

6. The device of claim 1, wherein the brush applicator comprises a handle and a brush, the brush being located inside the second compartment and away from the membrane when the brush applicator is in the locked position.

7. The device of claim 6, wherein the second compartment comprises an inner skirt formed inwardly from a top surface of the second compartment, the inner skirt defining an opening to receive the brush applicator.

8. The device of claim 7, wherein a lip is formed on the inner skirt such that the lip engages the handle of the brush applicator so as to tightly seal the opening when the brush applicator is in the locked position.

9. The device of claim 8, wherein the lip is in a substantially inverse V shape, and is thin and flexible enough to allow the brush applicator to be movable in and out through the opening.

10. The device of claim 1, wherein the first compartment comprises female threads and the second compartment comprises male threads, the male threads of the second compartment corresponding to the female threads of the first compartment such that the male threads of the second compartment can screw into the female threads of the first compartment so that the first compartment is removably attachable to the second compartment.

11. The device of claim 1, wherein a top portion of the second compartment can fit into and frictionally engage a bottom portion of the first compartment so that the first compartment is removably attachable to the second compartment.

12. The device of claim 1 further comprising a connector, the connector comprising an upper portion and a lower portion, the membrane attachable to the upper portion of the connector, the upper portion of the connector being configured to fit into and engage a bottom portion of the second compartment so that the membrane can be placed in the device, the lower portion of the connector comprising female threads, the third compartment comprising male threads, the male threads of the third compartment corresponding to the female threads of the connector such that the male threads of the third compartment can screw into the female threads of the connector so that the third compartment is removably attachable to the connector.

13. The device of claim 1 further comprising a locking member, the second compartment comprising a male portion configured to engage the first compartment so that the first compartment is removably attachable to the second compartment, the locking member capable of removably engaging the male portion of the second compartment such that the first compartment can engage a first part of the male portion when the locking member engages the male portion of the second compartment in order to hold the brush applicator in the locked position, wherein the first compartment can engage more than the first part of the male portion of the second compartment to allow the brush applicator to move toward the membrane to puncture the membrane when the locking member is removed.

14. The device of claim 1, wherein the membrane is made of a low-creep moldable thermoplastic elastomeric polymer.

15. The device of claim 1, wherein the membrane is made of a material selected from the group consisting of polyolefin blends, elastomeric alloys, thermoplastic polyurethanes, and thermoplastic copolyesters.

16. The device of claim 1, wherein the membrane is made of silicone.

17. The device of claim 1, wherein each of the second compartment and the third compartment is made of a material selected from the group consisting of polypropylene, polyethylene terephthalate, High-density polyethylene (HDPE), polycarbonate, and polyvinyl chloride.

18. The device of claim 1, wherein the brush applicator comprises a handle and a brush, the brush extending from the handle such that the brush is off-centered or situated away from the center of the handle.

19. The device of claim 1, wherein the first hair coloring chemical is a developer or oxidizing agent and the second hair coloring chemical is a color.

20. A method of mixing and applying hair coloring chemicals to a user's hair which comprises:

providing a device which comprises a first compartment holding a brush applicator in a locked position, a second compartment containing a first hair coloring chemical and being connected to the first compartment, a third compartment containing a second hair coloring chemical and being connected to the second compartment, a membrane located between the second compartment and the third compartment such that the first hair coloring chemical is separated from the second hair coloring chemical by the membrane, and a locking member preventing the brush applicator from contacting the membrane;

rotating the first compartment relative to the second compartment to remove the locking member so as to release the brush applicator from the locked position;

moving the brush applicator toward the membrane to puncture the membrane so that the membrane retracts to a peripheral edge of the membrane to cause the first hair coloring chemical and the second hair coloring chemical to be mixed together;

scooping the mixed first hair coloring chemical and second hair coloring chemical out of the device using the brush applicator; and combing a user's hair by the brush applicator with the mixed first hair coloring chemical and second hair coloring chemical thereon, thereby applying the mixed first hair coloring chemical and second hair coloring chemical to the user's hair.

21. The method of claim 20, which further comprises shaking the device after the brush applicator punctures the membrane to facilitate mixing the first hair coloring chemical and the second hair coloring chemical.

22. The method of claim 20, which further comprises removing the first compartment from the second compartment before scooping the mixed first hair coloring chemical and second hair coloring chemical out of the device.

23. The method of claim 20, wherein the first compartment comprises an outer layer and an inner layer, the inner layer of the first compartment defining an aperture to receive the brush applicator in the aperture.

24. The method of claim 23, wherein the locking member protrudes from an inside surface of the outer layer of the first compartment and engages a recess formed on the brush applicator when the brush applicator is in the locked position.

25. The method of claim 24, wherein a projecting element is formed on a top surface of the second compartment such that the locking member collides against the projecting element and is snapped off when the first compartment is rotated relative to the second compartment.

26. The method of claim 20, wherein the second compartment comprises a male portion configured to engage the first compartment so that the first compartment is removably attachable to the second compartment, the locking member capable of removably engaging the male portion of the second compartment such that the first compartment can engage a first part of the male portion when the locking member engages the male portion of the second compartment in order to hold the brush applicator in the locked position.

27. The method of claim 26, which further comprises removing the locking member from the device so that the first compartment can engage more than the first part of the male portion of the second compartment to allow the brush applicator to move toward the membrane to puncture the membrane.

28. The method of claim 20, wherein the first compartment comprises female threads and the second compartment comprises male threads, the male threads of the second compartment corresponding to the female threads of the first compartment such that the male threads of the second compartment can screw into the female threads of the first compartment so that the first compartment is removably attachable to the second compartment.

29. The method of claim 20, wherein the membrane is made of a low-creep moldable thermoplastic elastomeric polymer.

30. The method of claim 20, wherein the membrane is made of a material selected from the group consisting of polyolefin blends, elastomeric alloys, thermoplastic polyurethanes, and thermoplastic copolyesters.

31. The method of claim 20, wherein the membrane is made of silicone.

32. The method of claim 20, wherein each of the second compartment and the third compartment is made of a material selected from the group consisting of polypropylene, polyethylene terephthalate, High-density polyethylene (HDPE), polycarbonate, and polyvinyl chloride.

33. The method of claim 20, wherein the first hair coloring chemical is a developer or oxidizing agent and the second hair coloring chemical is a color.

34. A method of mixing and applying hair coloring chemicals to a user's hair which comprises:

providing a device which comprises a first compartment holding a brush applicator in a locked position, a second compartment containing a developer or oxidizing agent and being connected to the first compartment, a membrane enclosing an end of the second compartment, and a locking member preventing the brush applicator from contacting the membrane;

selecting a desired color to be applied to a user's hair;

putting the color in a third compartment;

attaching the third compartment containing the color to the device;

rotating the first compartment relative to the second compartment to remove the locking member so as to release the brush applicator from the locked position;

moving the brush applicator toward the membrane to puncture the membrane so that the membrane retracts to a peripheral edge of the membrane to cause the developer and the color to be mixed together;

scooping the mixed developer and color out of the device using the brush applicator; and combing the user's hair by the brush applicator with the mixed developer and color thereon, thereby applying the mixed developer and color to the user's hair.

35. The method of claim 34, wherein the device further comprises a connector, the connector comprising an upper portion and a lower portion, the upper portion of the connector being configured to fit into a bottom portion of the second compartment, the membrane attaching to the upper portion of the connector, the upper portion of the connector with the membrane attached thereto engaging the bottom portion of the second compartment to place the membrane in the device.

36. The method of claim 35, wherein the lower portion of the connector comprises female threads, the third compartment comprising male threads, the male threads of the third compartment corresponding to the female threads of the connector such that the male threads of the third compartment can screw into the female threads of the connector so that the third compartment is removably attachable to the connector.

37. The method of claim 34, wherein the first compartment comprises female threads and the second compartment comprises male threads, the male threads of the second compartment corresponding to the female threads of the first compartment such that the male threads of the second compartment can screw into the female threads of the first compartment so that the first compartment is removably attachable to the second compartment.

38. The method of claim 34, which further comprises shaking the device with the third compartment attached thereto after the brush applicator punctures the membrane to facilitate mixing the developer and the color.

39. The method of claim 34, which further comprises removing the first compartment from the second compartment before scooping the mixed developer and color out of the device.

40. The method of claim 34, wherein the first compartment comprises an outer layer and an inner layer, the inner layer of the first compartment defining an aperture to receive the brush applicator in the aperture.

41. The method of claim 40, wherein the locking member protrudes from an inside surface of the outer layer of the first compartment and engages a recess formed on the brush applicator when the brush applicator is in the locked position.

42. The method of claim 41, wherein a projecting element is formed on a top surface of the second compartment such that the locking member collides against the projecting element and is snapped off when the first compartment is rotated relative to the second compartment.

43. The method of claim 34, wherein the membrane is made of a low-creep moldable thermoplastic elastomeric polymer.

44. The method of claim 34, wherein the membrane is made of a material selected from the group consisting of polyolefin blends, elastomeric alloys, thermoplastic polyurethanes, and thermoplastic copolyesters.

45. The method of claim 34, wherein the membrane is made of silicone.

46. The method of claim 34, wherein each of the second compartment and the third compartment is made of a material selected from the group consisting of polypropylene, polyethylene terephthalate, High-density polyethylene (HDPE), polycarbonate, and polyvinyl chloride.

* * * * *